US008654997B2

(12) United States Patent
Meehan, Sr. et al.

(10) Patent No.: US 8,654,997 B2
(45) Date of Patent: Feb. 18, 2014

(54) PERSONAL MINIATURIZED LOUDSPEAKER PLACEMENT PLATFORM

(76) Inventors: Donald Eugene Meehan, Sr., Indianapolis, IN (US); Frances Rhodes Meehan, Indianapolis, IN (US)

( * ) Notice: Subject to any disclaimer, the term of this patent is extended or adjusted under 35 U.S.C. 154(b) by 155 days.

(21) Appl. No.: 13/048,318

(22) Filed: Mar. 15, 2011

(65) Prior Publication Data

US 2011/0228959 A1 Sep. 22, 2011

Related U.S. Application Data

(60) Provisional application No. 61/315,277, filed on Mar. 18, 2010.

(51) Int. Cl.
*H04R 5/02* (2006.01)

(52) U.S. Cl.
USPC ..... 381/307; 381/386; 381/87; 108/64

(58) Field of Classification Search
USPC ..... 381/307, 300, 1, 119, 386, 387, 79, 80, 381/77, 87; 108/64, 65, 66, 180, 185
See application file for complete search history.

(56) References Cited

U.S. PATENT DOCUMENTS

| | | | | |
|---|---|---|---|---|
| 3,746,792 | A | 7/1973 | Scheiber | |
| 4,107,461 | A | 8/1978 | Bose | |
| 5,809,150 | A | 9/1998 | Eberbach | |
| 6,381,335 | B2 | 4/2002 | Juszkiewicz | |
| 6,853,732 | B2 | 2/2005 | Scofield | |
| 6,944,309 | B2 * | 9/2005 | Terai et al. | 381/309 |
| 7,367,886 | B2 | 5/2008 | Loose | |
| 2005/0108954 | A1 | 5/2005 | Sola | |
| 2006/0256976 | A1 | 11/2006 | House | |
| 2008/0159571 | A1 | 7/2008 | Hooley | |

* cited by examiner

*Primary Examiner* — Vivian Chin
*Assistant Examiner* — Con P Tran

(57) ABSTRACT

An improved method and materials for retaining small loudspeakers to a platform composed of adjustable connecting miniaturized members utilizing international standards for surround sound in meters, but reduced to inches. One example would be a scale of one inch equaling one foot, but not limited to that particular miniature scale. The present invention utilizes any and all technical aspects of sound delivery and amplification in a miniature scale arrangement with the multi-directional surround sound. The speakers so mounted in measured inches from the center-point midway between the ears of the listener, delivers multi-directional sound in a re-creation of a musical, movie or gaming experience in the same perspective as being in a room with large speakers at high listening levels or a theater setting. Listening in the miniaturized setting, the listener will experience the same high levels in decibels as in the large room setting.

1 Claim, 15 Drawing Sheets

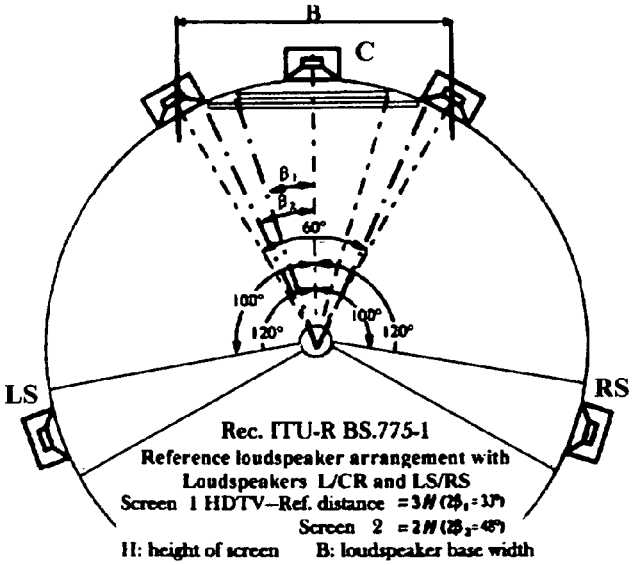
(PRIOR ART)
FIG. 1A
| Loudspeaker | Horizontal angle from centre (degrees) | Height (m) | Inclination (degrees) |
|---|---|---|---|
| 12 | 0 | 1.2 | 0 |
| L,R | 30 | 1.2 | 0 |
| LS, RS | 100___120 | ≥ 1.2 | 0__down |
FIG. 1B
(PRIOR ART)
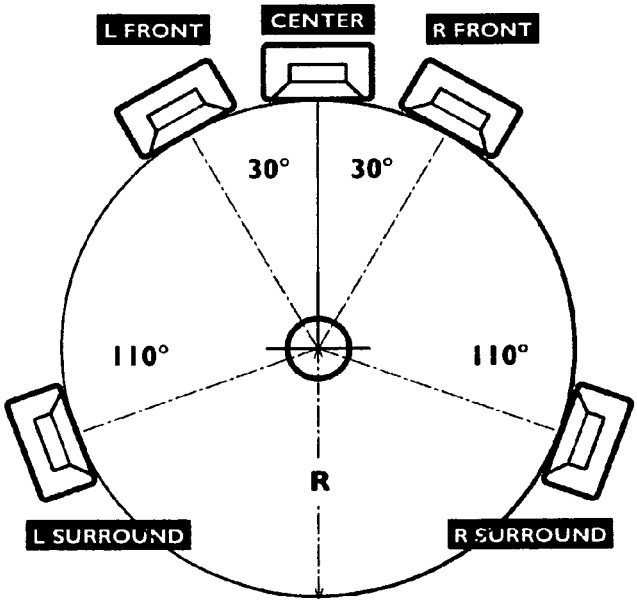

24 foot circle with a 12 foot radius (*PRIOR ART*)

24 inch circle with a 12 inch radius

FIG. 3
(PRIOR ART)
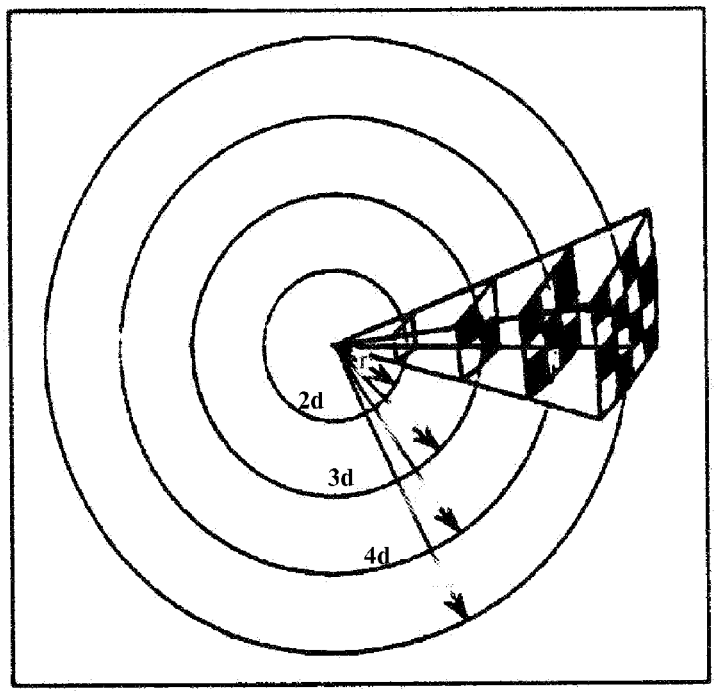
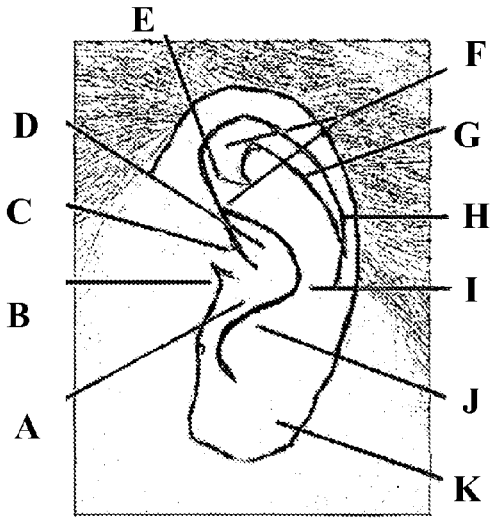
FIG. 4 (PRIOR ART)
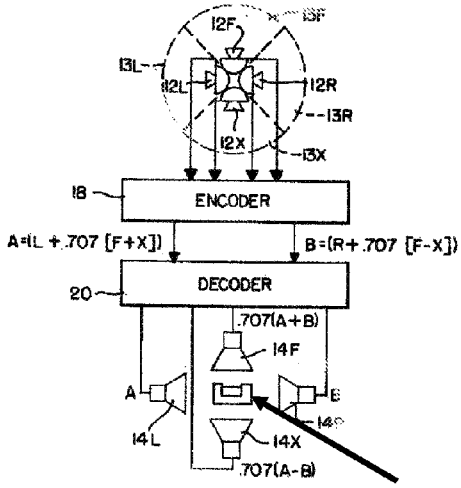
FIG. 5 (PRIOR ART)

FIG. 6A
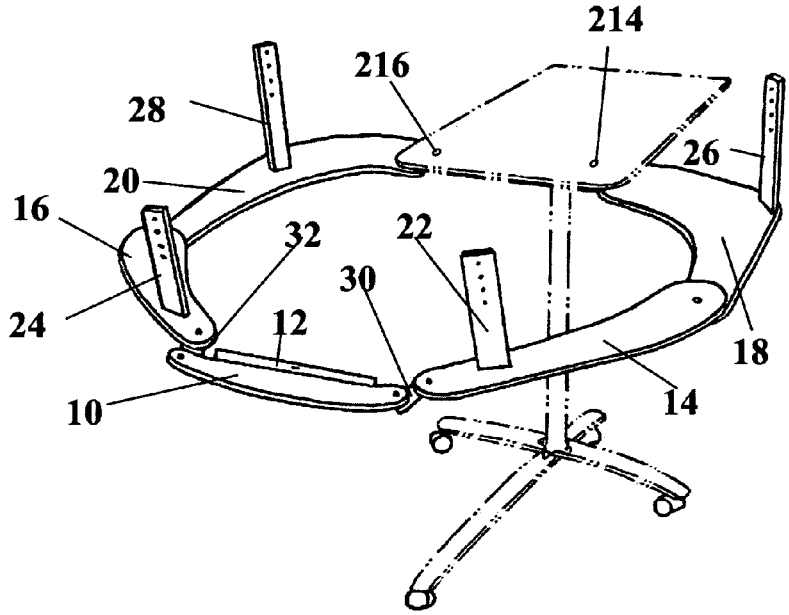
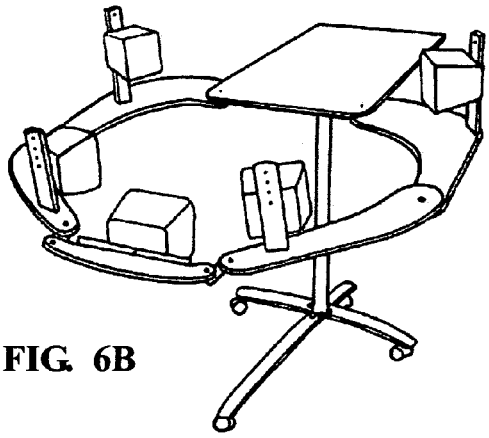
FIG. 6B
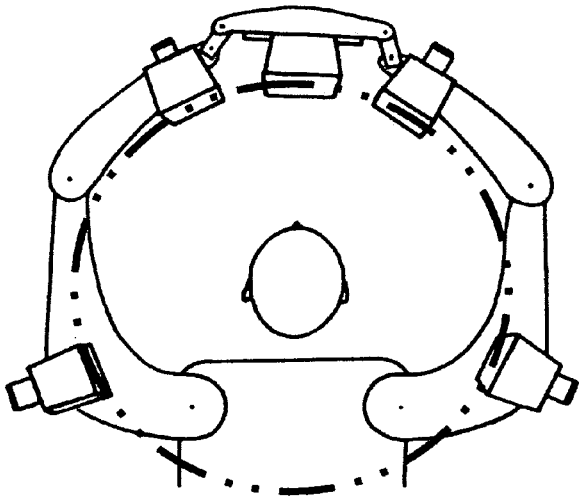
FIG. 7

FIG. 17
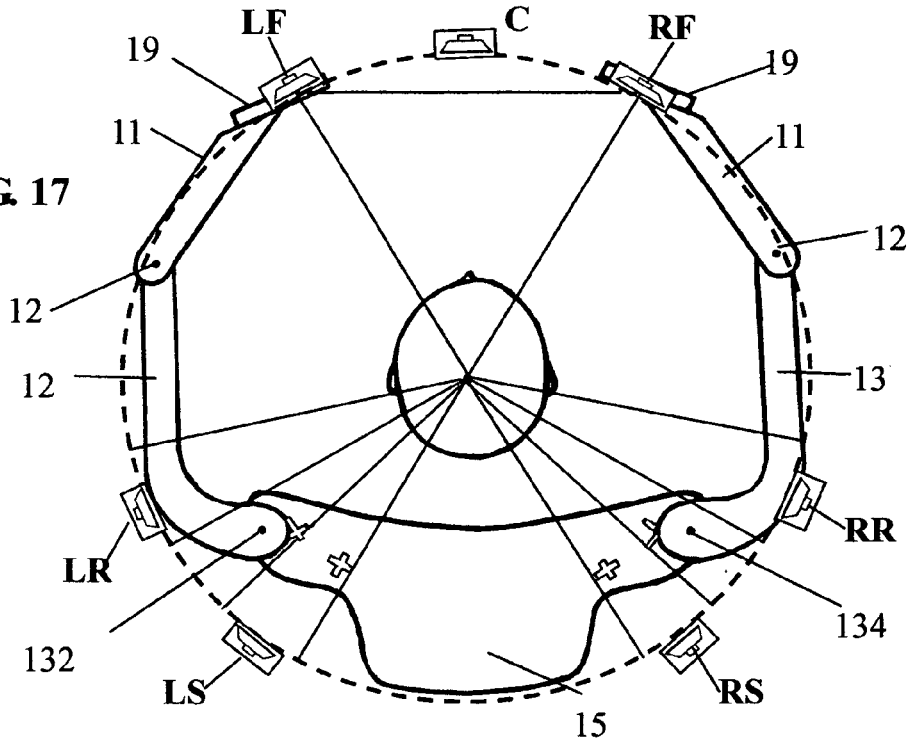
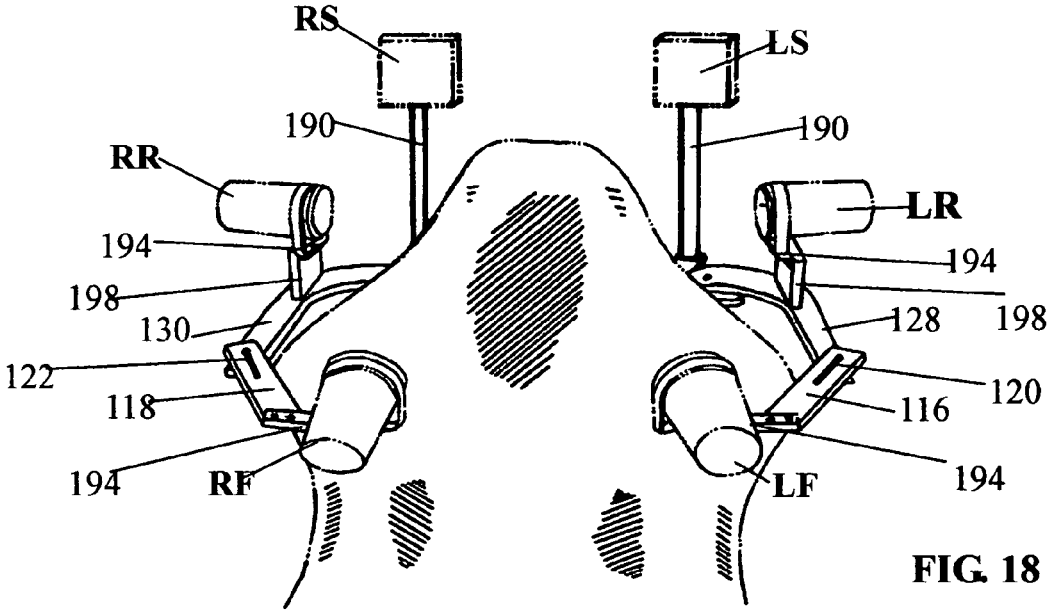
FIG. 18

FIG. 21
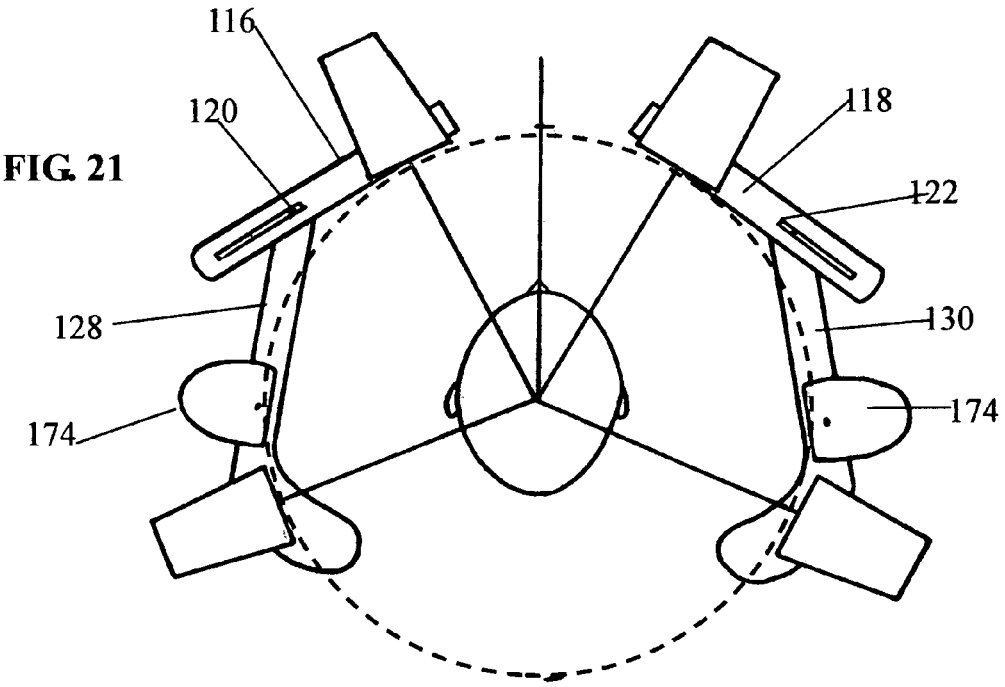
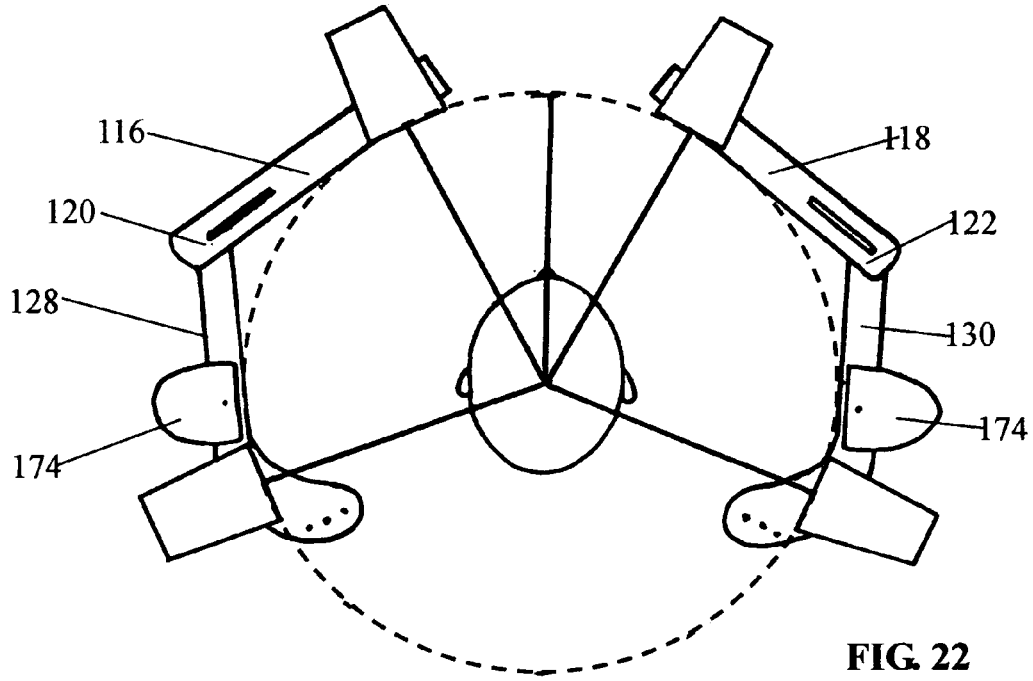
FIG. 22

FIG. 25
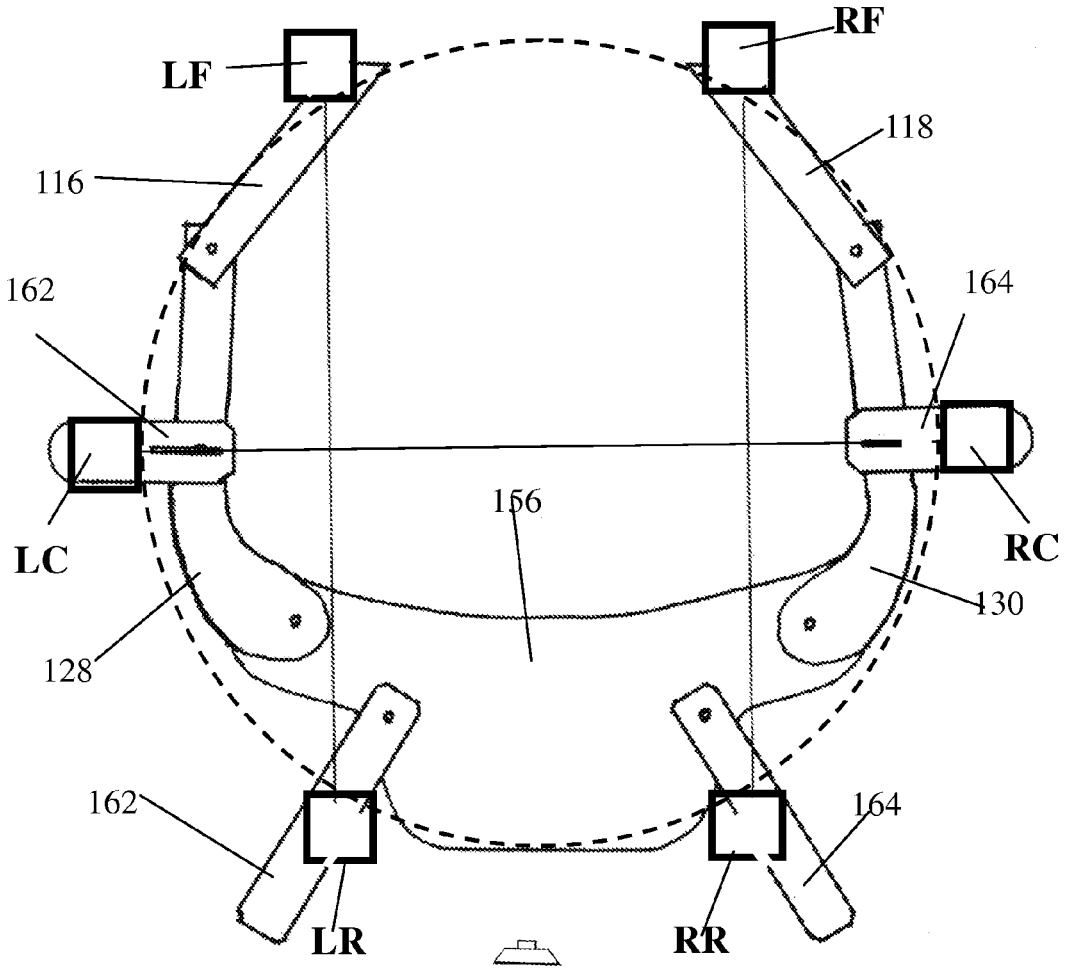
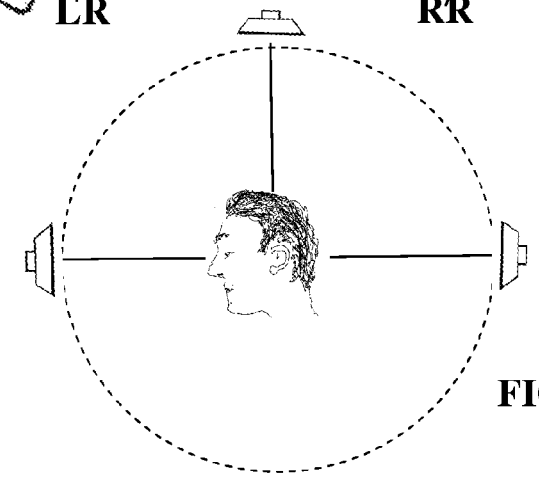
FIG. 26

PERSONAL MINIATURIZED LOUDSPEAKER PLACEMENT PLATFORM

CROSS REFERENCE TO RELATED APPLICATIONS

This application claims the benefit of provisional patent application Ser. No. 61/315,277, filed 2010 Mar. 18 by the present inventors.

FEDERALLY SPONSORED RESEARCH

Not Applicable

SEQUENCE LISTING OR PROGRAM

Not Applicable

BACKGROUND

1. Field

This application relates to an improved method and apparatus for listening to multi-directional surround sound by mounting small loudspeakers in a miniaturized setting on a loudspeaker placement platform based on inches instead of the conventional setting of feet or meters for listening to multi-directional surround sound.

2. Prior Art

In all conventional multi-directional surround sound environments, the larger loudspeakers are placed in a large and full sized measured circle at prescribed angles and distances in feet or meters, usually in a room setting with chairs, or an auditorium or theater setting. Great pains and effort is exerted with large powered expensive amplifiers and loudspeakers in place in carefully designed sound-proofed and treated rooms with comfortable chairs and sofas.

A main concern and purpose of the present invention is cost to produce and cost to the consumer. The smaller speakers can be designed and produced to provide the highest quality at a much lower cost than those of a higher wattage rating. Amplifiers that drive the smaller speakers can be manufactured with much lower output ratings and at lower costs, and only very small speaker wire is needed for such small runs and low wattage, compared to large gauge and long cables required for large room setups. Wireless speakers can also be utilized.

The two speaker stereo effect was originally created by placing speakers in the front corners in an available studio mixing room, an enclosed mobile studio truck, or studio control room of perhaps twelve or fifteen by sixteen or twenty feet, which expanded to even more square footage to accommodate more spectators, producers, directors, etc. Some international standardization then began, with instructions such as the ITU-R BS. 775-1 published recommendations as in FIGS. 1 and 1B. But available room spaces of the consumer are also variable and usually limited in size. Standards have evolved whereas sound level measurements of the various speakers are in order to balance accurately with the front speakers and to achieve the same results in the home environment as was intended in the studio mix room.

In reference to multi-directional surround sound, nowhere in any descriptions in the prior art have we found any reference whatsoever to speaker placement in inches referring to a miniaturized setting, or to speaker distances measured in miniature scale in inches as opposed to feet or meters for delivering multi-directional or surround sound.

Drawings in the surround sound prior art usually always designate a chair, or a sofa, representing where a listener may be seated while listening to multi-directional or surround sound music or motion pictures. Dolby® Laboratories, Inc. also publishes production guidelines for mixing engineers, manufacturers, and consumers on setting up proper loudspeaker listening rooms with a goal of producing repeatable reference listening experiences in different listening environments. Although the International Standards (AES, EBU, ITU and SMPTE) alignment levels may differ, the guidelines are universal in maintaining a reasonable setup for Dolby® Laboratories' products as well as other manufacturers' products. All references are for feet or meters, it being understood internationally that the references are for studio mixing rooms, motion picture mixing setups for theaters and home theater setups for the consumer.

Descriptions of all the surround sound prior art regarding methods and apparatus for surround sound refer to speakers being placed in a room setting or a theater, and the assumption appears to be universal that the speaker distance to the listener is described and understood to be in feet or meters. Other of the surround sound prior art describes speakers placed at an arbitrary distance on chairs and on video gaming equipment with only a suggestion of reproducing sounds of the original studio mix only in an approximation of what the studio recording mixer intended. Nowhere in the surround sound prior art have we found any reference whatsoever to a distance in inches or in a miniaturized setting such as one inch to the foot, one and one quarter inch to the foot, one and one half inches to the foot, two inches to the foot, or any scale in miniature. Even the aforementioned Dolby® Inc. published recommendations as with their recommended angles of speaker placement to listener, show a large couch with four seats at the listener seating position and all viewing distances in feet.

The widely accepted professional standard for speaker placement for multi-channel sound reproduction is the ITU-R BS.775-1. The standard identifies a few well known points including the positioning of the reference listening point at the center of an imaginary circle having a radius between 2 m (78.74 inches or 6.56 feet) and 4 m (157.48 inches or 13.123 feet), which are minimum and maximum radius defined in the ITU-R BS.ll 16-1 recommendation. According to the standard, a center speaker should be placed at a zero-angle reference position directly ahead of the listening point. There should be 60° between the front left and right speakers, with the center speaker in the middle. Both rear speakers, left and right should be placed within 100° to 120° from the zero-angle reference position, also known as the center line. The acoustical axis of the front speakers—as defined by the speakers' manufacturer—should be approximately at the listener's ear height. The height of the rear speakers may be less critical and an inclination of up to 15° can generally be accepted. The standard also recommends that each of the five speakers be positioned more than 1.1 meter from any wall located behind the speaker.

Surround sound prior art historically has referred to a sound mixing room or large and small theater settings with the recording or mixing engineers facing an ultimate listening arrangement having loudspeakers spaced in front of, to the side and to the rear of the mixing engineer based on what has become standard placement, with the prescribed definitions of so-called 5.1, 7.1, 9.1, 10.1, 22.1, etc. All of these placements can be utilized in our improved miniaturized setting. Surround sound prior art definitions have derived from the studio and mixing engineers' experiences of remixing productions of music, movies, games etc., at a console, summing or mixing the various instruments, sound effects, audience reactions, explosions, battlefield, flyovers, etc., and listening to the loudspeakers extending from a one speaker monaural placement, to a wide extension of stereo, to speakers across the front, to side and rear speakers, emulating an approximate 360 degree span of sound.

In recording control rooms, it is common to place small loudspeakers on the meter bridge at the rear of the recording console. These are called near-field or close-field monitors because they are generally at an accepted distance of 3 to 5 feet from the listener. House, in application Ser. No. 11/273,876, describes his invention as "near-field" which is not anywhere near our miniature distances of 12 inches, whereas he states that all of his speakers can be located at a distance from the position of the listener, where R (radius) is generally between about 0.5 meter (19.685 inches) and 1.5 meter (59.055 inches), which is considerably closer than the range given in the ITU-R BS.1116-1 recommendation. Further, House states an embodiment with a diameter of about 1.2 meter (47.244 inches) so that the radius R was about 0.6 meter (23.622 inches), thus allowing the listener situated at that position to employ near-field monitoring techniques.

One of the inventors, Donald Meehan, a sound mixing engineer at CBS/Sony Music from 1963 to 1996, was actively mixing 2 channel stereo in those studios when Scheiber's Quadraphonic system was first introduced at the studio. Meehan and fellow engineer, Raymond Moore, shared the same mixing room and added a speaker to each corner in the back of the room and were among the first to mix Quadraphonic sound. Meehan recalls that no thought or consideration whatsoever was given to any other speaker placement except sitting and listening at a console in a mix room setting such as in Scheiber's description, and for playing it back in the same home listening setup approximating the studio mix room setup.

Further, in U.S. Pat. No. 3,746,792, Scheiber's continuation of U.S. Pat. No. 3,632,886, he defines and clarifies as it being in a "room", whereas he writes: "The system provides for reproduction of sound from four loudspeakers located in the four corners of a room and having nominal positions with respect to the listener of left front, right front, left rear and right rear . . . . It is convenient to think in terms of a multidirectional sound system with four loudspeakers situated in the corner of a substantially square room reproducing material having four input signals corresponding in direction to the four loudspeakers utilized in reproduction. Such an arrangement is encompassed in the preferred embodiment of the system."

Other surround sound prior art such as Scofield and Saunders' U.S. Pat. No. 6,144,747 introduces tiny speakers built into a pair of eyeglasses, whereas the two tiny front speakers are supported that they are "proximate" to the left and right ears, with no prescribed measurement nor distance from the ear, and not corresponding to what the recording mixing engineer heard and reproduced in the original recording. Other surround sound prior art introduces several tiny speakers located on the earphones above the head of the listener with channeling to the ears to simulate direction, with circuitry to induce a virtual artificial placement of the sound coming to each ear. In all of these surround sound prior art methods there is a suggestion of "virtual" and no true representation whatsoever of what the mixing engineers heard and re-recorded in their final mixes.

In U.S. Pat. No. 5,809,150, Eberbach states that "The surround sound effect is also more pronounced in miniature (close range) speaker configurations because the energy gradient between the right and left . . . ." However, there is no reference whatsoever to miniature scale and his drawings all depict a person sitting in a chair or couch with speakers placed at obviously more than "miniature" distances from the listener.

In Hooley's application Ser. No. 11/632,438, entitled "Miniature Surround Sound Loudspeaker", there is no reference whatsoever to miniature scale placement of speakers. Juszkiewicz also refers to a room setting in U.S. Pat. No. 6,381,335 B2 and states that his system includes a cabinet having a bottom surface for placement upon a desk and having a top surface for supporting a computer monitor and that at least first, second and third speakers are housed in the cabinet. Fourth and fifth speakers are located remote from the cabinet. Thus, the cabinet will include the left front, center front and right front speakers along with the sub-woofer speakers, all of which will have outlets from the cabinet directed toward a person using the computer. The left and right rear speakers are remote speakers and will preferably be mounted on conventional microphone stands or the like placed in the room behind the user of the computer. Again there is no reference to miniaturized placement of speakers.

Additional surround sound prior art describes a simulation of surround sound within headphones, or earphones, claiming surround sound and sometimes referred to "virtual surround sound," which in the true meaning, is not really surround sound at all, but a false representation based on manipulation of circuitry and loudness that creates a sense of distance or movement simulating "virtual" surround sound. Some surround sound prior art such as Sheng-Hsin Liao's U.S. Pat. No. 7,436,073B2, encompasses several drivers within each earpiece, suggesting front, side and rear placement of sound direction, but no consideration of the Inverse Square Law or reference to miniaturization, or International standards for multi-directional surround sound.

In the surround sound prior art, whether near field or far field, one must consider the various effects of standing waves, reflections off walls, speaker and amplifier deficiencies and equalization. This adds to the ultimate cost of treating the studio mixing room. The same kinds of problems occur also for the listener in the home or in the theater. In smaller rooms it is just not practical to use a 7.1 system, and a 5.1 room is often difficult or impossible to set up according to standards. However, surround sound in 7.1 is definitely becoming the norm for all gaming and motion picture production, and the present invention will serve those needs well.

Home theater and computer speakers utilizing the stereo and 5.1 concept are traditionally understood to be placed in a room setting with the design principles incorporated to go from very reasonably priced to very expensive. The present invention can accommodate either. The restrictions on placement of speakers in a studio, home or other location where a recording is to be played back often restrict where the speakers may be placed. Room sizes vary greatly, as do desks and platforms for the personal computer speakers. Most computers today are sold with 7.1 soundcards. However, establishing a listening area at the seating arrangement of a computer with any more than a two track stereo setup can be inconvenient and cumbersome, and even with that setup, there is usually no consideration of the original recording mixing circumstances. One usually just puts a speaker at each side of a computer monitor with no consideration of distance to listener. However, the present invention's miniaturized platform will accommodate the computer person easily.

In full size room settings utilizing the surround sound prior art, consideration is always in order for the various effects of standing waves, reflections off walls, speaker and amplifier deficiencies and equalization etc., possibly making the ultimate cost of treating any room as well as the studio mixing room extremely high. This treatment is not the case or necessary with a miniaturized system utilizing the present invention. Therefore, the miniaturized speaker platform could also easily be used by the mixing engineer. The same kinds of problems occur also for the ultimate listener in the home or in the theater in order to faithfully re-create the sound heard in the mixing room.

Extending to the usual 5.1 and 7.1 and higher speaker arrangements, the drawbacks and necessary preparations and expense in reproducing sound with the surround sound prior art are increased. In today's open area rooms there usually isn't even a place to hang the extra (two) surround channel speakers for 7.1 surround sound. Therefore, home consumers could create a 7.1 system only if they were looking at a large dedicated home theater room that has the depth and wall space required. In smaller rooms it just isn't practical to use a 7.1 system, and a 5.1 room is often difficult or impossible to set up. The miniaturized loudspeaker platform will accommodate easily.

Close speaker arrangement is suggested in video games and arcade consoles in the prior art with a person facing a machine with mounted speakers both on the apparatus and on the headrest or back of the unit or chair, only in a "proximate" position to the head of the player, or listener. However, there is no suggestion whatsoever of calculated and measured miniaturization mentioned or suggested. Other surround sound prior art suggests only an approximate representation of surround sound, and some with speakers placed in an enclosure to surround the listener with no specifications in inches. Surround sound prior art also mentions speaker mounting on automobile seats and/or airplane seats to simulate surround sound, and inventions of earphones that simulate and make false claims of "true surround sound" that only produce a "virtual" simulation of sounds around the listener.

The more expensive high powered amplifiers such as 500 to 1000 watt rated in most expensive home theater surround sound systems are certainly not required for the present invention, and a high quality amplifier with very little distortion and extremely lower power in watts can provide the ultimate listening experience at a fraction of the cost of the more expensive equipment and eliminate room acoustic treatment.

In the surround sound prior art utilization of full size speakers in a normal setting, adjustment of the delay between the front and rear speakers is important when calibrating a system. But in our miniature setting of the present invention, these delay settings are not required, since we are referring to inches instead of feet. And the sound reaches the ears in around $1/100^{th}$ of a second at 12 inches from the speakers as compared to $1/10^{th}$ of a second at 12 feet.

The purposes and advantages of such a setup in miniaturization are many. Close speaker arrangement is suggested in video games and arcade consoles in the surround sound prior art, with a person facing a machine with mounted speakers both on the apparatus and on the headrest or back of the unit or chair, only in a "proximate" position to the head of the player, or listener. These and other surround sound prior art merely suggest an approximate or arbitrary representation of surround sound, and some are made with speakers placed in an enclosure to surround the listener with no specification for speaker to ear distance. None of the surround sound prior art suggests details of the duplication of the original mixing room speaker placement in feet, as determined in a miniature setting as we do with the present invention. However, the present invention in miniature could be an advantage if utilized in those settings, providing a personal environment. The present invention will duplicate the large sale settings in a miniaturized setting. The term, "loudspeaker" will hereinafter be referred to as "speaker."

The sound production in miniature concerning the present invention will equal the original recorded near field, also sometimes called close field, and/or far field mix from the studio utilizing loudness and power wattage at a fraction of the so-called "normal" listening levels and loudness. Much of the prior art make claims of surround sound, when in fact there is no surround whatsoever. Several have sounds bouncing off a wall with speaker arrangements that are mounted in a vertical tower manner in front of the listener. Another presents an array of speakers lined up in front of the listener, while others proximate body distance with reference to surround sound with the close mounting of video games and machines, and arbitrary automobile mounting on the backs of seats and mounting tiny speakers into eyeglass mountings. One surround sound prior art invention regarding surround sound vaguely mentions placing speakers on a seat or a chair, with only an arbitrary distance to listener. However, nothing has been found in the surround sound prior art with any suggestion of measured inches in a miniature placement as compared to feet or meters. Earphones and headphones have been invented that claim surround sound, but all of these have neglected the all important role of the human ear's pinna, which will be discussed later herein.

A sound wave is affected by the distance traveled, the humidity, and the frequency of the sound. The miniaturized setting is comparable to listening in a multitude of different real life settings and is especially useful and appealing to gamers, with the same considerations of distances of the ears to speakers. Standards have been instituted for placement in full size settings in feet and meters only, to include two track stereo up to 7.1 surround sound. Since rooms are so different and including large and small, high ceilings and low ceilings, then standardization in a home theater setting appears to be almost impossible and the listener may only be guessing as to what the recording mixing engineer intended.

Although we claim a unique placement of speakers not heretofore claimed and to be explained herein, the present invention makes no claims whatsoever to any new findings of surround sound or multi-directional circuitry, except for the embodiment of a miniaturized platform of 180 degrees behind and 90 degrees above the listener's ears, which will be explained later herein. The present invention provides a unique platform of prescribed dimensions for available small speaker placement in a miniature setting in inches compared to feet or meters, in scale, for any and all surround sound prior art regarding surround sound and/or directional sound reproduction. An example would be that if in a real life room setting left loudspeaker A and right loudspeaker B were placed twelve feet from the listener, the miniaturized placement of one inch to the foot, the speakers would now be placed twelve inches from the listener's center-point, which we define as the center of the head between the ears.

A main concern and purpose of the present invention is cost to produce and cost to the consumer. Smaller speakers can be designed and produced to provide the highest quality at a much lower cost than those of a higher wattage rating. Amplifiers that drive the smaller speakers can be manufactured with much lower output ratings and at lower costs, and only very small speaker wire is needed for such small runs and low wattage, compared to large gauge and long cables required for large room setups. Wireless speakers can also be utilized.

The following are a few of the known conventional prior art listening arrangements with their descriptions, all of which the Personal Miniaturized Loudspeaker Placement Platform can accommodate:

(a) Conventional Stereo, with two speakers placed in front of the listener, Dolby® Digital surround sound system that gives you completely independent multi-channel audio.

(b) Dolby® Digital EX, which creates 6 full-bandwidth output channels from 5.1-channel sources.

(c) Dolby® Pro Logic II, which is an improved technique used to decode vast numbers of existing Dolby® Surround sources.

(d) Dolby® Pro Logic IIx, which is a new technology enabling discrete multichannel playback from 2-channel or multi-channel sources.

(e) Dolby® Surround, which uses a 4-channel analog recording system to reproduce realistic and dynamic sound effects:

(f) Dolby® TrueHD, which is an advanced lossless audio technology developed for high-definition disc-based media including HD DVD and Bluray Disc.

(g) Direct Stream Digital (DSD) technology, which stores audio signals on digital storage media, such as Super Audio CDs.

(h) DTS 96/24, which offers an unprecedented level of audio quality for multi-channel sound on DVD video, and is fully backward-compatible with all DTS decoders.

(i) DTS digital surround, which was developed to replace the analog soundtracks of movies with a 6.1-channel digital sound track, and is now rapidly gaining popularity in movie theaters around the world.

(j) DTS Express, which is an advanced audio technology for the optional feature on Blu-ray Disc or HD DVD, which offers high-quality, low bit rate audio optimized for network streaming, and Internet applications.

(k) DTS-HD Master Audio, which is an advanced lossless audio technology developed for high-definition disc-based media including HD DVD and Blu-ray Disc.

(l) DTS-HD High Resolution Audio, which is an high resolution audio technology developed for high-definition disc-based media including HD DVD and Blu-ray Disc.

(m) HDMI (High-Definition Multimedia Interface), which is the first industry-supported, uncompressed, all-digital audio/video interface.

The aforementioned list does not preclude any new or undiscovered conventional listening arrangements of surround sound with their descriptions. While various embodiments of the invention have been described, it will be apparent to those of ordinary skill in the art that many more embodiments and implementations are possible within the scope of the invention. The Personal Miniaturized Loudspeaker Placement Platform can perform standardization in an exact manner with a perfect placement in inches as compared to feet, by recreating exactly what the mixing engineer heard in the original mix. And if the mix room specifications are published as to exactly what the speaker placement was at the time of the mix, then the home listener can re-create exactly what was intended by the mixing engineer in a miniaturized setting.

The first five figures represent the basis for the concept of miniaturization of multi-directional surround sound as compared to full size prior art, and the all important role of the "pinna" of the human ear. FIGS. 1A and 1B are the ITU-R BS.775-1 standards from the International Telecommunication Union published pages, which show recommended feet and angles for proper speaker placement for surround sound to mix or reproduce sound in a 5.1 configuration of speaker placement. FIG. 2A is a diagram with ITU standards recommendations for 5.1 and 7.1 speaker placement in a 24 foot circle with a 12 foot radius. Left front speaker is designated as LF. Right front speaker is designated as RF. Left rear is designated as LR. Right rear is designated as RR. Left 7.1 surround speaker is designated as LS, and Right 7/1 Surround speaker is designated as RS. The surround speakers are to be located at 135 to 150 degrees from the center point. The sub-woofer for a 5.1 and a 7/1 system is generally located on the floor. But with an embodiment shown in FIGS. 6A, 6B and 7, with the invention placed on a laptop computer stand, there is room for the subwoofer as well as gaming equipment and amplifiers on said stand behind the listener. FIG. 2B is a diagram of ITU standards recommendation for 5.1 and 7.1 speaker placement with a 12 inch radius and is identical to FIG. 2A but in a miniaturized 24 inch circle. This speaker placement defines distance to speakers from a center-point between the listener's ears inside the head. The distance from the listener center-point, which is the center of hearing inside the listener's head, to each speaker is the radius of the circle, and in this case, is approximately 12 inches. The center speaker is added for reference but is optional for the present invention. FIG. 3 is a representation of the Inverse Square Law, which holds the same principles for sound as for light, and holds true in a miniaturization of sound measurement as in actual size measurement. The plot of this intensity drop shows that it drops off rapidly. The sound intensity from a point source of sound will obey the Inverse Square Law if there are no reflections or reverberation.

In the angle shown in FIG. 3 the same sound energy is distributed over the spherical surfaces of increasing areas as d is increased. The intensity of the sound is inversely proportional to the square of the distance of the wave-front from the signal source. Example: 1d=1, 2d=4, 3d=9, 4d=16, etc. The inventor, Donald Meehan, in addition to being a sound engineer and sound mixing engineer, is also a long time expert in the business of miniature art, working mostly in one twelfth scale, or one inch to the foot, experimenting, making and photographing miniature objects in all miniature scales, including ½ inch to the foot, 1 inch to the foot, 2 inches to the foot, etc. His published book, "The Art Of Photographing Miniatures" describes action of light in space and how the effects of distance of light from a subject decreases logarithmically, in the exact same way that sound travels and decreases.

Both light and sound vary as the square of the distance and invokes the Inverse Square Law (See FIG. 3). An example of this are the f stops on a conventional camera such as the designations of f4, f6.3, f8, f11, f16, f22, f32 that all are familiar with. These f stops are derived from the indication of actual footage of light falling off in intensity as it moves away from a subject. Using a photographer's light meter, an example of this would be like the measurement of a certain amount of light from a 400 watt light on a subject at 4 feet with the shutter open perhaps one second. Moving the 400 watt light to 6.3 feet reduces the amount of light to half, or the equivalent of a 200 watt light on the subject. Moving the light to 8 feet away from the subject reduces the light on the subject to half again or the equivalent of a 100 watt light on the subject. Thus, it an be seen that moving the light one half the distance reduces it one fourth the intensity, and inversely, it increases the intensity the same as with sound. The realization that light as well as perspective in miniature photography acts the same in inches as in feet and that sound follows the same rules has led to this invention. Thus, the same conditions apply to sound in miniature. Under ideal conditions a free field could be represented by a sound signal being generated from a mountain peak. In real life situations however, rooms bounded by walls, floors and ceilings will interrupt the inverse square law at a distance in an average 30 foot square room at approximately 10-12 feet from the sound source. Nevertheless it is important to accept the notion that sound will diminish in intensity with distance. For example, in a typical classroom with a teacher's voice signal of 65 decibels at a three-foot distance from the teacher; at 6 feet away the sound intensity will be 59 decibels and at twelve feet it will diminish down to 53 decibels. If you were standing 20 feet from a loudspeaker, and were to move to 40 feet away from that loudspeaker, you would expect to see a drop in level of 6 dB. FIG. 4 Shows the human ear with its pinna and other parts. Manufacturers of surround sound earphones and many who make full size surround sound speaker units neglect the most important role of the human ear's pinna (pronounced as pin-nah), which helps the listener determine direction of sound from the rear (See FIG. 4).

The ten parts of the anatomy of the pinna in medical/scientific terms is indicated herein to underline the significance of its role in human hearing. A is the Cavum Conchae, B is the Tragus, C is the Crus of Helix, D is the Cyma Conchae, E is the Fossa Triangularis, F is the Crura of Antihelix, G is the Scaphoid Fossa, H is the Helix, I is the Antihelix, J is the Antitragus, and K is the Lobule. All of these parts play an important role in what we hear. The miniaturization in the present invention preserves the all important role of the pinna. The pinna which is the outer part of the ear serves to "catch" the sound waves and helps one determine the direction of a sound. If a sound is coming from behind or above the listener, it will bounce off the pinna in a different way than if it is coming from in front of or below the listener. This sound reflection alters the pattern of the sound wave. One's brain recognizes distinctive patterns and determines whether the sound is in front of, behind, above or below the listener. While reflecting from the pinna, sound also goes through a filtering process which adds directional information to the sound. The filtering effect of the human pinna preferentially selects sounds in the frequency range of human speech. Amplification of sound by the pinna, tympanic membrane and middle ear causes an increase in level of about 10 to 15 dB in a frequency range of 1.5 kHz to 7 kHz. This amplification is an important factor in inner ear trauma resulting from elevated sound levels. The pinna works differently for low and high frequency sounds. For low frequencies, it behaves similarly to a reflector dish, directing sounds toward the ear canal. For high frequencies, however, its value is thought to be more sophisticated. While some of the sounds that enter the ear travel directly to the canal, others reflect off the contours of the pinna first. These enter the ear canal at a very slight delay. Such a delay translates into phase cancellation, where the frequency component whose wave period is twice the delay period is virtually eliminated. Neighboring frequencies are dropped significantly. This is known as the pinna notch, where the pinna creates a notch filtering effect. Therefore, since the pinna helps define sounds coming from the back of the person, the present invention with 5.1 and 7.1 assures of faithfully reproducing sounds coming from behind and to the side of the listener the same as a full size speaker setup or real life listening. The aforementioned delay and phase cancellation is no different in the miniaturized setup.

FIG. 5 is a drawing from Scheiber's U.S. Pat. No. 3,632,886 of his Quadrasonic sound system with a chair (unnumbered by Scheiber) drawn in with our arrow pointing to said chair. There is no doubt that Scheiber's Quadrasonic sound system refers to a room setting and shows a drawing of an obvious seat or a chair and fails to show a number reference, but the seat or chair is surrounded by drawn speakers designated 14L, 14R, 14F, 14X. And then he states, "Reference to locating sound on a circle around a listener means the ability to locate virtual sound sources in front of, behind, or to the sides of a listener but is not intended to limit or define the precise placement of the speakers." However, it is obvious here that Scheiber refers to placement in feet, with no reference whatsoever or consideration of a miniature setup in miniature scale or inches. The seat or chair for the listener is drawn in and included in a drawing of U.S. Pat. No. 3,632,886 and not numbered nor referred to. We have placed an arrow pointing to the drawn seat or chair in FIG. 5. Scheiber continues, "The benefits of the invention can best be provided where at least one of the speakers is located behind the listener and the speakers are arranged in fact on the circumference of a circle, with the listener located at the center . . . . Where a full four-channel system is used, it is possible to locate a source of sound at any point on a full circle around the listener." It is obvious from Scheiber's drawing of the chair and Scheiber's writing of "any point" clearly means "any point" in feet, specifically of a room, and has no reference in any way to a miniaturized placement of speakers. But, in the present invention, we are, in fact, defining the placement of speakers to mean distance strictly in "inches" at the prescribed angles as compared to feet in a normal setting. Therefore, any reference whatsoever of Scheiber's writing and drawing in U.S. Pat. No. 3,632,886 clearly refers to speaker placement in feet and in no way refers to a miniaturized placement of speakers.

ADVANTAGES

A number of embodiments of the invention are described herein. Nevertheless, it will be understood that various modifications may be made without departing from the spirit and scope of the invention. For example, some of the steps described herein may be order independent, and thus can be performed in an order different from that described:

(a) The purpose of the present invention is to arrange speakers to duplicate realistic sound in a miniature setting, in any variety of so called scale sizes such one inch to the foot, and any fraction of an inch to the foot, listening to 2.1, 5.1, 7.1 and any and all present surround sound applications or any other applications that may be introduced in the future, including the embodiment described in FIG. 27.

(b) All existing so-called smaller computer speakers and equipment can be utilized, spaced and attached to and used with the present invention in accordance with the angles and dimensions and adjustments herein. Not being expensive to manufacture, whether in a kit form, or included by a manufacturer with one of its surround sound amplifier/speaker packages, the present invention can be produced with any light weight metal, plastic, Plexiglas®, PVC, wood or any other heretofore unknown suitable substance.

(c) Most any small and low wattage speaker system can be used on the Platform from low cost speakers to higher quality expensive speakers, giving the same results of two track stereo to multi-dimensional sound reproduction. Small inexpensive amplifiers and speakers may be used instead of high powered units since there is little wattage needed to perform up to 90 to 100 or more decibels, inches away instead of feet.

(d) Due to the very short lengths of wiring with the close spacing of the speakers, there is no need for expensive and cumbersome low gauge or thick wiring. High quality Personal Miniaturized Personal Loudspeaker Placement Platform units can be used in the studio while mixing by sound mixing engineer and everyone present can wear an identical personal unit and hear exactly what the mixing engineer hears.

(e) Since the sound at several inches from the speakers is miniscule and is dispersed quickly at several feet, the individual in the home environment can listen to loud 85 to 90 or more decibel levels at close range without disturbing others or neighbors.

(f) Tests show that while monitoring the Personal Miniaturized Personal Loudspeaker Placement Platform producing ordinary average movie theater sound levels of 85 decibels, others in the same room would only hear 15 to 20 decibels less level, or around 70 to 75 decibels. In a next room with door closed the level would drop about 30 to 35 decibels or to about 60 to 55 decibels. In a next room between walls, very faint imperceptive sounds may be heard. However, it is doubtful that any sounds whatsoever of 85 decibels could be heard in between apartments in a complex.

(g) Provided the specifications of the original mixing engineer's studio speaker actual distance and angles are published, the consumer can translate feet to inches and duplicate almost exactly what the mixing engineer heard when it was mixed.

(h) Due to the very close placement of the speakers to the individual listener, there is little or no concern about room acoustics, standing waves, or room reverberations interfering with the sounds produced by the speakers used in the present invention. Unlike the drawbacks of full size placement in the surround sound prior art, whether using in the studio or in the home theater environment, there are negligible sounds bouncing off walls or equipment too low to even be considered.

(i) All prescribed angles and distances of speaker to listener in any and all present and future applications of the art can be utilized with the descriptions and explanations herein, without exception.

(j) The apparatus can be used anywhere with the same results, even in bed.

(k) Simple adjustments in inches or fractions (simulating actual size adjustments in feet) are easily made on the present invention with a slight twist or turn of the individual speakers and with prescribed screw movements in the designated cutouts and slots.

(l) Assuring that the listener can be situated only a few inches from the speakers, the unit can be hung around the listeners neck with a harmonica type holder, or mounted on a hanging position over the shoulder, mounted on a music type stand or laptop computer type stand designed to either face the listener or approach from the back, mounted on two microphone stands placing the speakers at each side of the listener, mounted on a so-called gamers' or other type chair, and spread out for the computer person.

(m) The present invention is a universal mounting system which insures that most any type or brand of speaker from low price to high price can be easily mounted.

(n) The present invention can duplicate the likes of a great concert hall or studio setting or of a large theater etc., in the confines of a few square feet with the home use. Therefore, a 12 by 15 by 8 foot room (180 square feet=1440 cubic feet) can be simulated in 180 square inches. And a 16 by 20 by 8 foot room (320 square feet=2560 cubic feet) can be simulated in 320 square inches. A concert hall or theater measuring as much as 200 by 300 by 50 feet (60,000 square feet=3,000,000 cubic feet) can be simulated within those same dimensions of a few square feet. A huge indoor or outdoor stadium with thousands in attendance can also be simulated within the same small confines.

(o) The center speaker in 5.1 and 7.1 listening can be eliminated or optional since there is little or no movement during listening. Slight head movement does not change the line of sight or sound.

(p) The perception of direction within the field is precise and accurate. Closing ones eyes, one can actually "see" the direction of certain instruments, according to the mixing engineer's panning of these sounds in the mix.

(q) The popular use of "near field" speakers at a few feet listening in the mix room can now be reduced to inches and replaced with "mini field."

(r) Damage to the hearing is possible in an environment of the surround sound prior art by everyone present having to listen on large studio speakers at the sometimes dangerous and consistent extended levels of 100 to 110 decibels and more. With the Personal Miniaturized Speaker Placement Platform, each listener can be comfortable in another room listening at his levels of choice and comfort, but also hearing exactly what the mixing engineer is hearing, but at a lower level. Extending this concept, if the mixing engineer wishes to listen and mix with speakers in a far field of speaker placement at ten to twelve feet or more, for instance, or in a near field placement of a three to five feet arrangement, or even mixing with the Personal Miniaturized Speaker Placement Platform, then all these speaker placement and distances can be published for the home listener to duplicate those placements and distances in the miniature setting with speakers on the home Personal Miniaturized Speaker Placement Platform.

(s) Thus, an example would be moving speakers from twelve feet to one foot, or twelve inches, and in scale miniaturist's terms, one-twelfth scale, which is one inch to the foot. Therefore, if the listener is listening at ninety decibels at twelve feet we can place the smaller speakers in front of the listener at twelve inches at the appropriate angle and decrease the ninety decibel levels at twelve feet proportionately to ninety decibels at twelve inches, we create the same sounds and levels duplicating what he hears now at twelve inches with the same level of ninety decibels.

SUMMARY

In a multi-directional surround sound setup in accordance with embodiments herein, for instance, one inch to the foot, a miniaturized speaker placement of twelve inches from the listener's center-point inside the head between the ears, duplicates a normal distance of twelve feet. This enables the listener to lower the listening level considerably to achieve the same listening experience. In effect, everything is smaller; speakers, amplifier power, cables, listening area, etc. In addition, the room acoustics, standing waves, walls, room reverberation, etc. are negligible or nonexistent and the delay is negligent. In the surround sound prior art there is great concern about room acoustics, standing waves, or room reverberations interfering with the sounds produced by the speakers placed several feet away from the listener. However, with the present invention, due to the very close placement of the speakers to the individual listener in the present invention, miniaturization eliminates the drawbacks of full size placement as in the surround sound prior art, whether using in studio or in the home theater environment.

BRIEF DESCRIPTION OF THE DRAWINGS

For a complete understanding of the present invention and the advantages thereof, all Figures refer to a miniaturized platform for holding small speakers in a miniaturized setting for personal listening to surround sound. Reference is now made to the following descriptions taken in conjunction with the accompanying Drawings in which:

FIGS. 1A and 1B are the ITU-R BS.775-1 specifications for reproducing 5.1 surround sound, which illustrate standards from the International Telecommunication Union published pages.

FIG. 3 is a diagram of the Inverse Square Law, whereas the energy twice as far from the source is spread over four times the area, hence one-fourth the intensity.

FIG. 4 illustrates the makeup of the different parts of the pinna of the human ear.

FIG. 5 is a drawing from Scheiber's U.S. Pat. No. 3,632,886 of his Quadrasonic sound system with a chair drawn in (chair not numbered by Scheiber) with our arrow pointing to said chair.

FIG. 6A illustrates a perspective view of a Surround sound 5.1 embodiment of the present invention that is attached to a laptop computer stand.

FIG. 6B illustrates how the embodiment would look with speakers, including the optional center speaker, attached to the poles.

FIG. 7 illustrates a top view showing members of the same 5.1 surround sound embodiment of the invention and how the various members connect.

FIG. 17 illustrates a top view of a layout for 7.1 surround sound for a gamer's chair, with the parts assembled from those shown in FIG. 16 with designated points for the speakers.

FIG. 18 illustrates a perspective view of a miniaturized 5.1 and 7.1 surround sound platform embodiment, mounted on a gamer's chair, minus the center speaker.

FIG. 21 shows a top view of a parts layout for an embodiment which would utilize a circle with a diameter of 22 inches and a radius of 11 inches.

FIG. 22 shows a top view of a parts layout for an embodiment which would utilize a circle with a diameter of 24 inches and a radius of 12 inches.

FIG. 25 is a top view of the parts assembled for an embodiment in the FIG. 27 perspective view of a new and unique miniaturized platform for speakers to radiate sounds from front, above and behind the listener. This is a new concept of a six speaker placement to provide 180 degree horizontal listening and 90 degree vertical listening that can utilize present 5.1 and 7.1 mixing standards.

FIG. 26 illustrates the speaker placement for the embodiment in FIG. 27 in front, above and behind the listener.

DETAILED DESCRIPTION

First Embodiment

Figure 15:
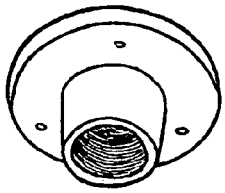
FIG. 15 illustrates a standard microphone stand screw mount with standard threading.

The present invention will now be described more particularly hereinafter with reference to the accompanying drawings, in which embodiments of the invention are shown. FIGS. 1 through 5 were explained heretofore in paragraphs 0045 through 0049. FIG. 6A is a perspective view of an embodiment of the Personal Miniaturized Loudspeaker Placement Platform that can attach to laptop computer stand as shown, or to any other type of stand with an adjustable height such as a heavy duty music stand. Because of the width of the prototype, we have chosen a scale of 1.167 inches to the foot for this embodiment, whereas 1.167 inch will equal 1 foot, and will have a 14 inch radius with a 28 inch diameter. Although the center speaker is shown mounted, it is truly optional, since the closeness of the left and right front speakers insure of an unmovable center signal and a true side to side stereo impression. Appropriate size machine screws, washers and nuts or preferably wing nuts of at least but not limited to size 10-24 can be used to fasten the various members together in all of the mentioned embodiments as shown in the exploded view of FIG. 11A. A drill of at least 3/16" should be used for all holes, but this is not to limit to any one size drill. Any size can be used to fit the chosen material used in construction. And this recommendation does not limit the methods of connecting the various members. Where a row of drilled holes are indicated in the drawings, a slot can also be used as explained later herein. Member 18, the rear left arm of the embodiment through either of two drilled holes at 62, will connect to the laptop computer stand as shown, or a music stand, at point 214. Member 20, the rear right arm of the embodiment through either of two drilled holes at 64, will connect to the laptop computer stand as shown or other type stand at point 216. Member 14, the left front arm, will connect at its drilled hole at 54, to the drilled hole at 58 of member 18. Member 16, the right front arm, will connect at its drilled hole at 56, to the drilled hole at point 60 of member 20. As noted before, the mounted center speaker is optional in our miniaturized platform as well as the center crossbar, 10, and center speaker attachment bar, 12. However, the following should be applied should there be a desire to add the center speaker, as well as to add a microphone stand at the front to accommodate heavier speakers. Member 12 is screwed onto member 10 at 46 and 48 or glued on as shown in FIGS. 6A, 6B, 7, 8 and 9. A standard microphone female screw mount such as the Atlas AD-11B, with a female ⅝"-27 socket adapter as in FIG. 15, is attached to the under side and in the exact middle of member 10. The adapter is available at any Atlas distributor and is a Surface-Mount Flange Microphone Stand Adapter (Female) with base diameter of 1¾" that works on any flat surface.

Figure 11A:
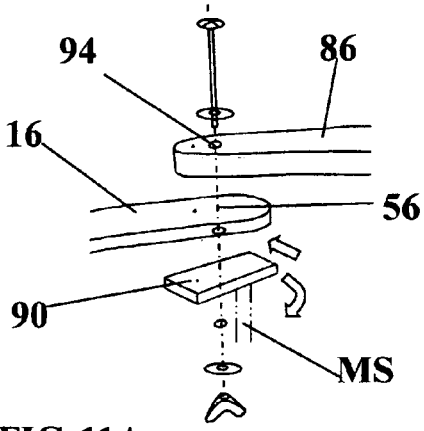
FIG. 11A illustrates an exploded view of how the machine screw connects the front and rear arms of the microphone stand embodiment.
Figure 11B:
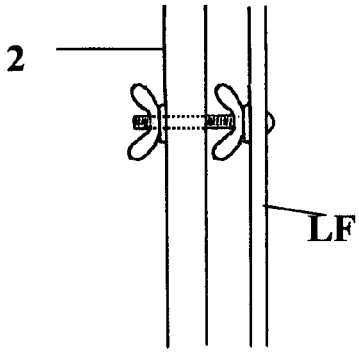
FIG. 11B shows how a speaker can be connected to one of the speaker poles.
Figure 12:
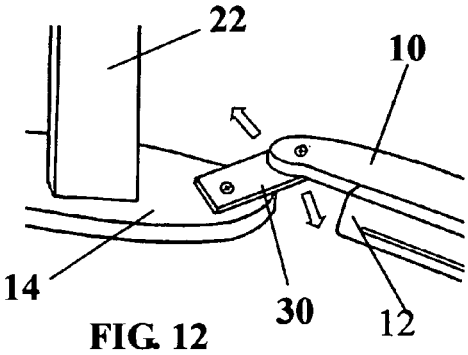
FIG. 12 illustrates the swivel connecting the front crossbar to the left and right side members.

A four inch spacer, 30, preferably but not limited to strong thin metal, at 34, connects to the front center crossbar member 10, at 42 to 50 of member 14 the left front arm. Member 10 at its 44 is connected to 36 of spacer 32, and the spacer's 40 connects to 52 of member 16, the right front arm. FIG. 12 shows how the swivel connections of 30 (and 32) provide additional adjustments for the center speaker distance to the listener. If the crossbar 10 plus 12 is desired, either to provide for the optional center speaker, or for extra stabilizing, a center microphone stand is shown connected to the center crossbar, 10, in the embodiment of FIG. 8. This front assembly and crossbar and LF, C and RF speakers and poles is exactly like the embodiment of FIGS. 6A, 6B and 7. A telescoping adjustable rod could also be used to brace the front, or a half inch to one inch dowel could be cut to the proper length to maintain a level placement of speakers, thus eliminating cost of the screw adapter and an extra microphone stand. Speaker poles are attached next. With a flathead screw from the bottom of member 18 the left rear pole, member 28 is held squarely in an upright position at 72. The front left speaker pole, 22, is screwed on upright at point 68. The right front speaker pole, 24, is screwed on upright at point 70, and the right rear speaker pole, 28, is screwed on upright on member 20 at point 74. Speakers usually have a keyhole hole or opening on the back and some larger center speakers are wider and provide two openings. Most all small speakers can be hung with Velcro® or with a machine screw, washers and two wing nuts as shown in FIG. 11B. An example is speaker pole 22 as shown with about a one and a half to two inch machine screw with it's head inside the keyhole of the speaker wall (LF), and with a washer and a wing nut tightened against the speaker wall, and fastened through a hole in the speaker pole. Another washer and wing nut is tightened on the outside of the speaker pole. A center speaker, if used is hung centered on the slot on member 12. Some manufacturers provide a wider center speaker, than the other four, and may require a mounting with two pan-head screws.

FIG. 6B illustrates how the embodiment would look with speakers, including the optional center speaker, attached to the poles. The left and right front speakers should be adjusted overall to be on the same level as the listener's ears, with the left and right surround speakers just a little above the listener's ear level. These adjustments can be made at 76, 78, 80 and 82. All speakers should be pointed directly at the listener's ears on each side. The game equipment, amplifiers and subwoofer can be located on the computer table behind the listener. FIG. 7 illustrates a top view of a pattern layout of the embodiment in FIGS. 6A and 6B showing members of a 5.1 surround sound embodiment of the invention connected, and how they connect together and poles on the pattern where small speakers are to be mounted. Speakers are also shown. A machine screw and wing-nut is preferred to attach the members together using the present patterns. In reference to the parts layout in FIGS. 13 and 14, the design and overall sizes of the members are not critical; however, the spacing of the drilled holes on the parts for a chosen miniature scale is critical in order to maintain the miniaturized aspects of the invention in the chosen scale. Starting with member 18, for example, for a miniaturized platform 1.167 inches to the foot scale, calling for a 14 inch radius with a 28 inch diameter, the prescribed distance between 58 and the farthermost drilled hole at point 62 should be 18½ inches. The middle hole of the five drilled holes at 72, should be 8¾ inches from 62, and 15½ inches from 58. When these two lines meet this will form a triangle as shown by the dotted lines on member 18 in FIG. 13. Therefore, as long as this triangle is evident with the prescribed distances, any shape can be give to this member. Note that there five drilled holes at 72 and 74, one inch apart, which provide for fine adjustments of the speaker later in setting up the platform. Additional holes can be drilled at points 58, 60, 62 and 74 to add to the fine tuning adjustments. Note also the holes to be drilled in all the speaker poles. The same principle can be applied to all drilled holes in the different members in all embodiments. One method for making certain that the speakers are actually lined up properly on the circle is to cut a piece of cardboard, or foam core board 28 inches in diameter, and make final adjustments at all the different points, ie, 72, 74, 42, 44, 50, 52, 54, 56, 58 and 60. The three holes at points 68 and 70 also provide adjustments. Anyone with skill in the art can change these measurements to suit the needs, and the size of any such stand selected. Also, a reversal of the platform is possible, utilizing the same circle and measurements, thus having the listener face the stand. This would call for having the front speakers mounted on the stand at the prescribed locations.

Additional Embodiment

Figure 2A:
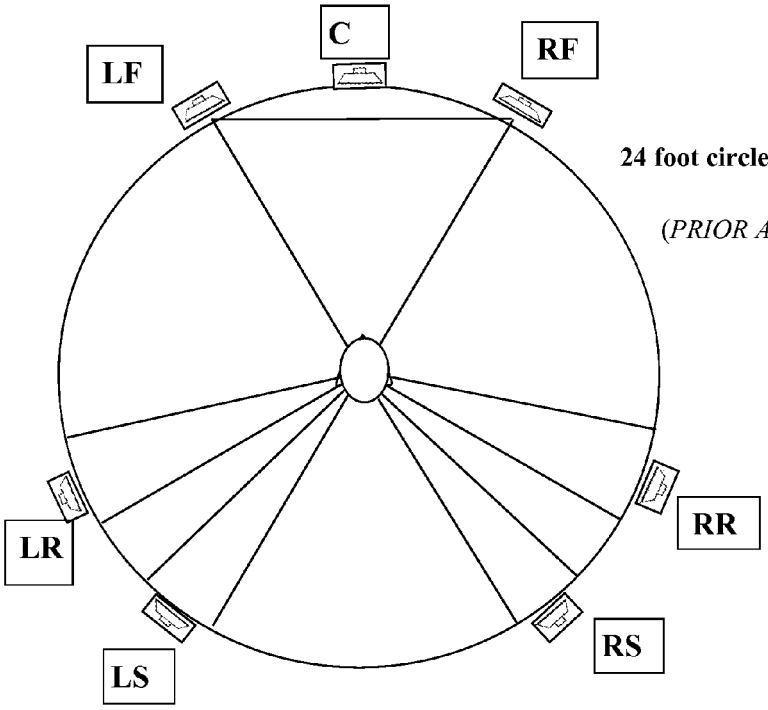
FIG. 2A is a diagram with ITU standards recommendations for normal 5.1 and 7.1 speaker placement in a 24 foot circle with a 12 foot radius, which defines distance to speakers from the listener's head.
Figure 2B:
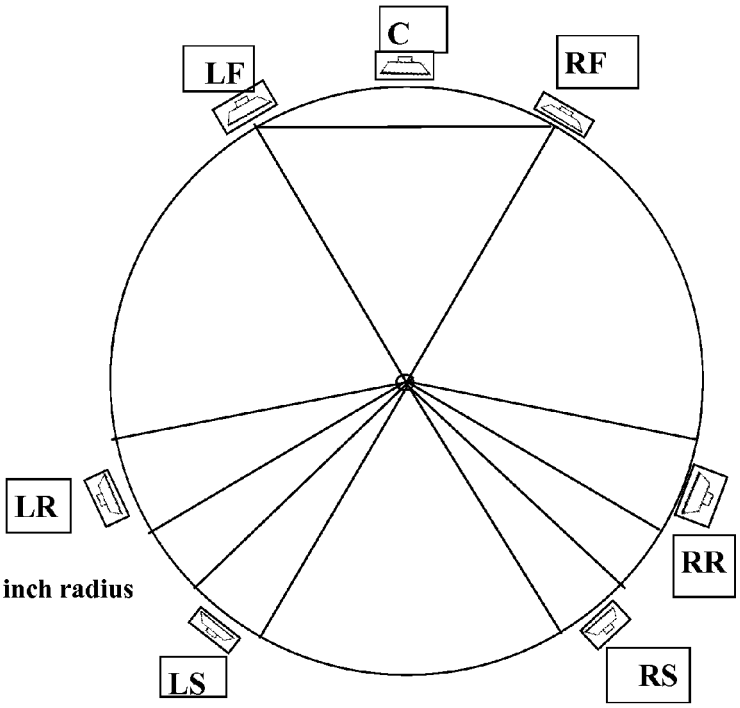
FIG. 2B is identical to FIG. 2A, a diagram with ITU standards recommendations for 5.1 and 7.1 speaker placement in a miniaturized 24 inch circle with a 12 inch radius, which defines distance to speakers from a center-point between the listener's ears inside the head.
Figure 8:
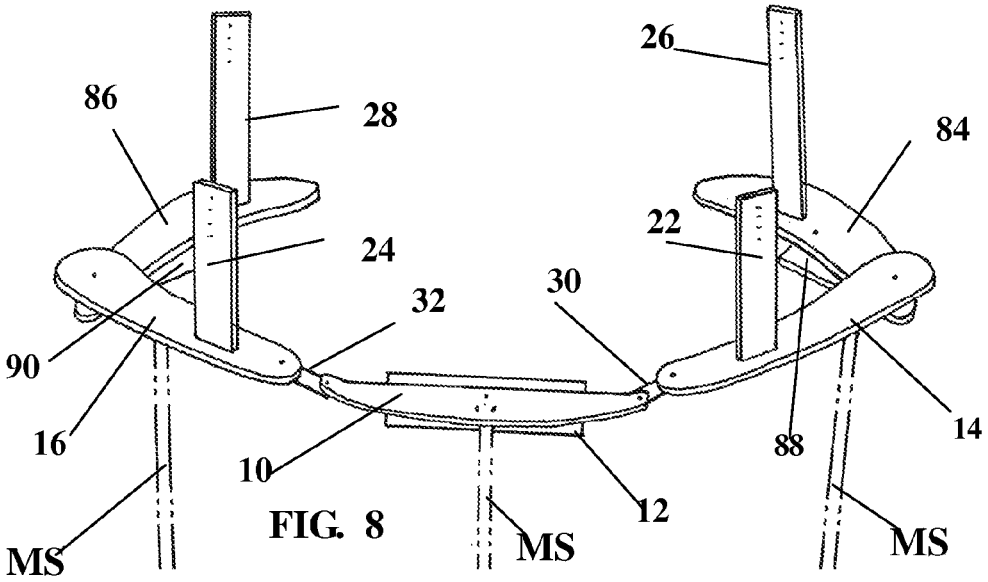
FIG. 8 is a perspective view of another surround sound 5.1 embodiment of the invention showing speaker placement and mounted in front of the listener on microphone stands.
Figure 9:
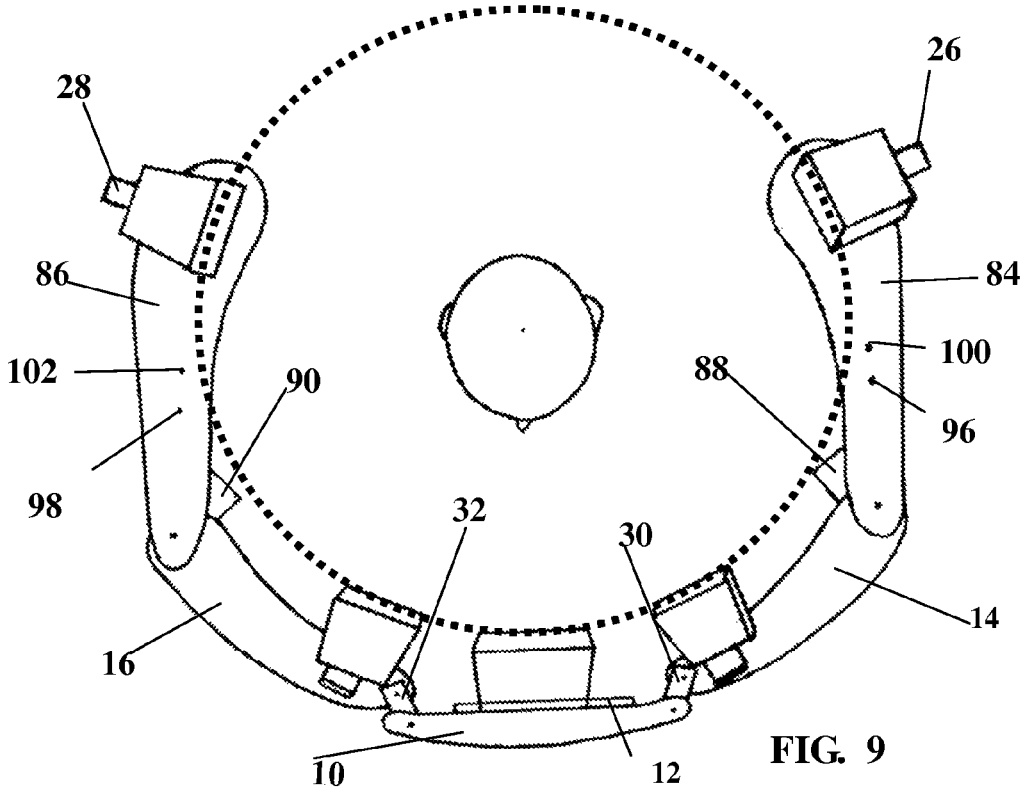
FIG. 9 illustrates a top view showing members of the same 5.1 surround sound embodiment of the invention in FIG. 8 and how the various members connect.
Figure 10A:
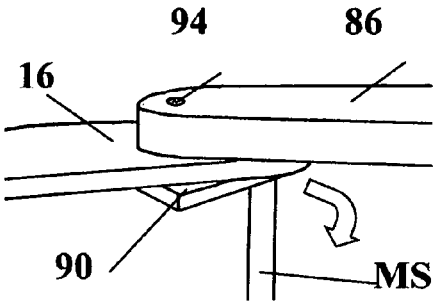
FIG. 10A illustrates one method of connecting the microphone stand to the side members of the embodiment shown in FIG. 8. The swivel turns to balance the weight of the front and rear speakers across the microphone stands.
Figure 10B:
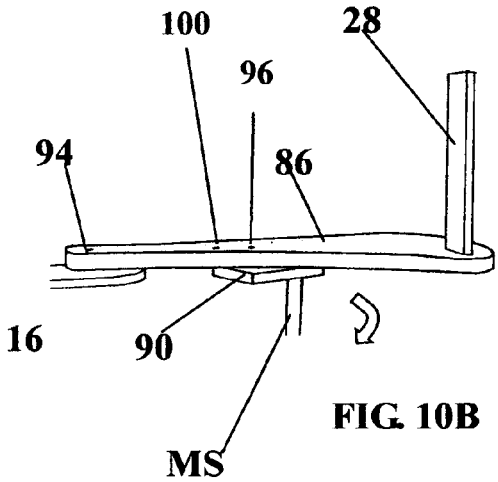
FIG. 10B relocates the swivel with the microphone stand attached and illustrates a cross sectional view of the connection of the members in 10A.

FIG. 8 illustrates another embodiment of the invention being mounted on microphone stands. The center speaker is shown mounted here also, but it is truly optional as explained heretofore. We have also chosen a scale of 1.167 inches to the foot for this embodiment, whereas 1.167 inches will equal 1 foot, and will have a 14 inch radius with a 28 inch diameter. This embodiment replaces the members 18 and 20 with the parts in FIG. 14, namely, 84, 86, and adds 88 and 90. The smaller left rear arm, 84, replaces the larger arm, 18, and 86 replaces 20. This replacement cuts down on the weight and size of the platform. The speaker placement is the same, as well as the front swivel action of 30 and 32. Standard microphone female screw mounts are attached to the bottom of members 88 and 90 at 108 and 110, with machine screws and nuts at 104 and 106. This is attached and connects member 100 to member 14 and member 86 to member 16 as in FIG. 10A. The swivel adjustment with members 88 and 90 allows the microphone stand to be moved in a circle in any direction as shown in FIGS. 10A and 11A, and this turning helps to balance the weight of the speakers on the two microphone stands. Members 88 and 90 can also be removed from the aforementioned position, and moved further back on the 84 and 86 members as in FIG. 10B to 100 or further back to 96. As in the former embodiment, a microphone female screw mount can be attached to the front crossbar 10, and be suspended by a third microphone stand. Again, the subwoofer can be located on a nearby floor, or on a table or desk close to the listener. FIG. 9 illustrates a top view showing members of the same embodiment of the invention in FIG. 8 and how and where the various members and speakers connect. Note the circle drawn in dotted lines around showing that the five speakers are lined up at their prescribed angles according to measurements of the parts as indicated. Therefore, a 28 inch round cutout can be made from cardboard or foam core and used to adjust the speakers to be the required 14 inches from the listener's center-point spot inside the head. FIG. 10A illustrates one method of connecting the microphone stand (MS) to the side members of the embodiment shown in FIG. 8. The swivel turns with the microphone stand attached to balance the weight of the front and rear speakers across the microphone stands, and to also move the microphone stand base away from the listener's chair. Longer members (88, 90) can be provided should microphone base and chair legs be too close together. FIG. 10B illustrates how to relocate the swivels 88 and 90 further back on the rear arm 84 (and 86), to 98 or 102 on the left, and to 96 or 100 on the right side. Relocating this way moves the microphone stand (MS) back further and the weight of the arms and heavier speakers for a better balance of weight between front and back.

Figure 13:
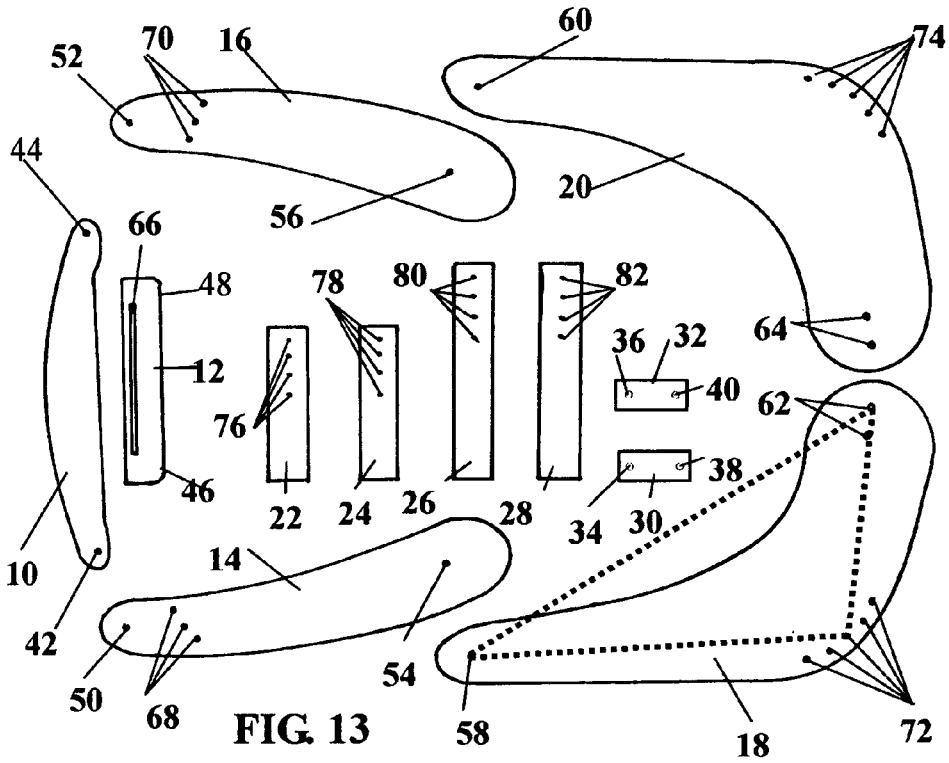
FIG. 13 is a top view of the parts unassembled for construction of a platform for a miniaturized 5.1 and/or 7.1 surround sound embodiment as shown in FIGS. 6 and 7.
Figure 14:
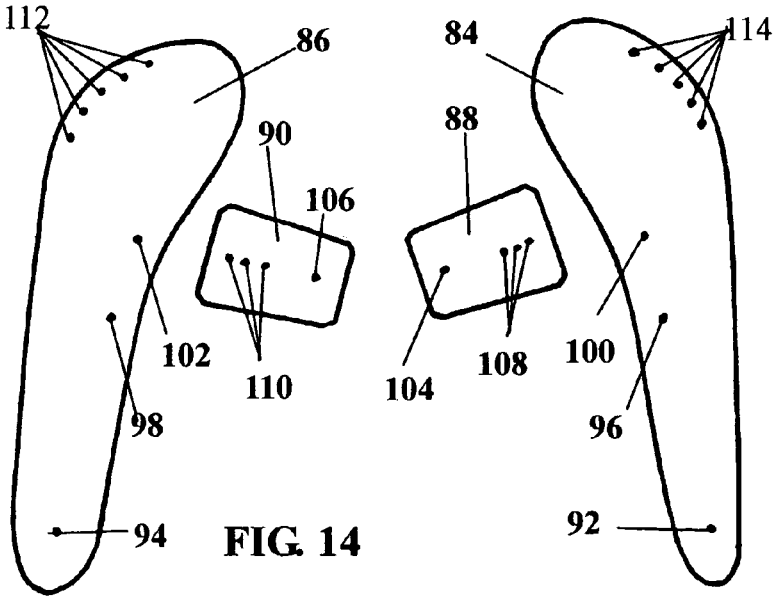
FIG. 14 illustrates a top view of the additional parts substituting the two rear arm members in FIG. 13, for use on an embodiment held up by microphone stands. Two blocks for moving the side microphone stand back further to adjust weight and balance of using heavier speakers.
Figure 16:
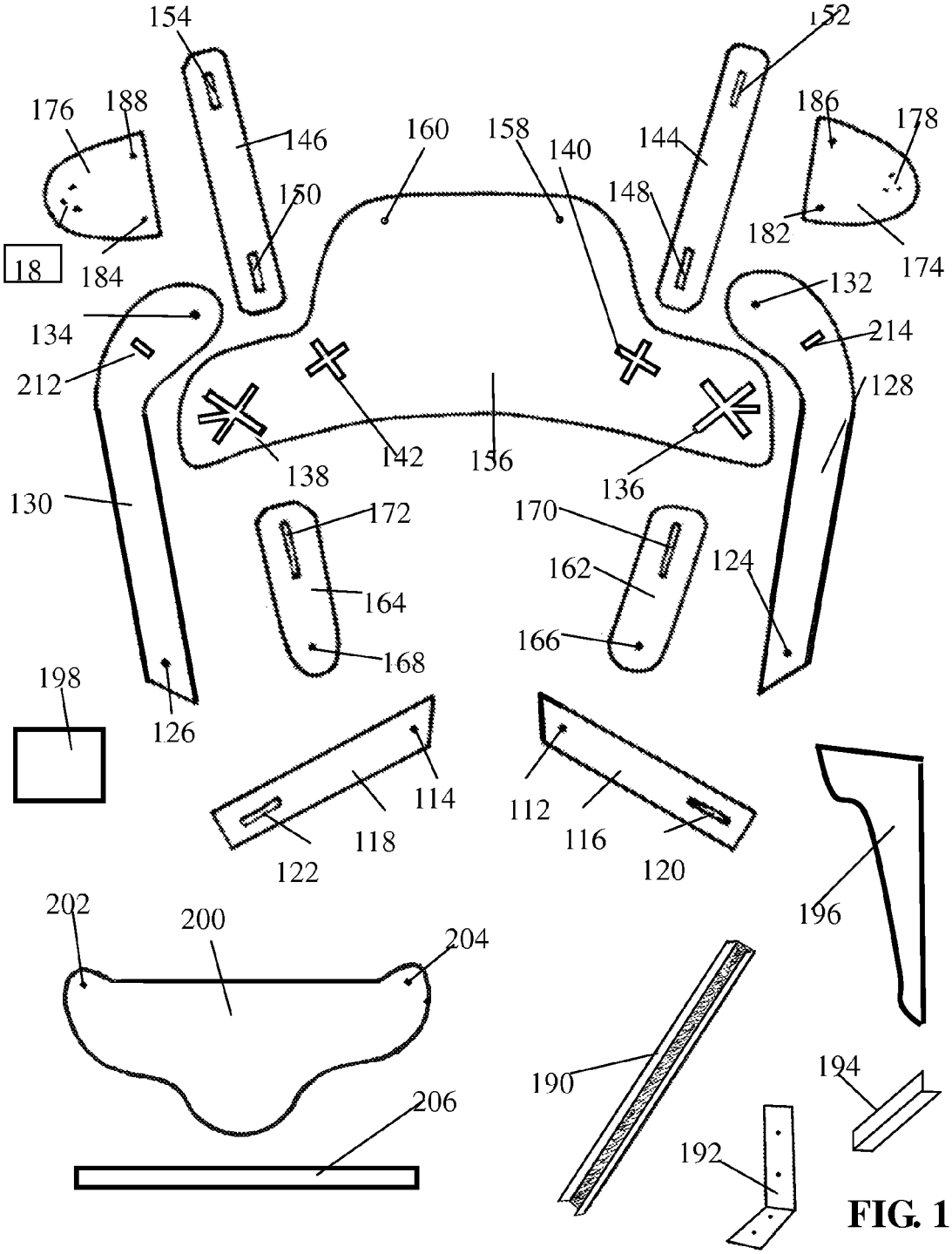
FIG. 16 is a top view of a parts layout for construction of three other embodiments.

FIG. 11A illustrates an exploded view of how the machine screw and wing nut, or regular nut, connects the front and rear arms of the microphone stand embodiment, as well as all the other assemblies of the parts. FIG. 11B shows how a speaker can be attached to one of the speakers poles. The head of the machine screw is placed into the keyhole of the speaker. A washer is inserted and a wing nut is applied and although difficult to tighten without being able to hold the screw head inside the speaker, is tightened as much as possible. The screw is inserted into the speaker pole and a washer is applied and a wing nut is applied and tightened to hold the speaker in place. An alternative way of fastening is to use Velcro®. Another simple method is to screw the speakers right onto the poles. FIG. 12 illustrates the swivel connecting the front crossbar to the left and right side members 10 and 14, and acts as an adjustment for maintaining the speakers at the designated chosen miniaturized distance from the center spot in the listener's head. FIG. 13 is a top view of the parts unassembled for construction of a platform for a miniaturized 5.1 and/or 7.1 surround sound embodiment as shown in FIGS. 6A, 6B and 7. For ease in building, members 18 and 20 are identical only reversed, as well as members 14 and 16. A series of drilled holes of at least ⅛" to 3/16" are indicated at 68, 72, 74, 76, 78, 80, 82, 108, 110, 112 and 114, which represent adjustment areas to fine tune the overall circular arrangement of the speaker placement. Those drilled holes may also be substituted with rectangular slots as indicated in FIGS. 16 at 120, 122, 136 and 138, etc. FIG. 14 illustrates a top view of the additional parts substituting the two rear arm members in FIG. 13, for use on an embodiment held up by microphone stands. Two blocks are included, 88 and 90, and standard microphone stand screw mounts, 15, applied to each member for moving the side microphone stand further back to adjust weight and balance of using heavier speakers. FIG. 15 illustrates a standard microphone stand screw mount with standard threading ⅝" 27 threads per inch Unified Special thread (UNS, US and the rest of the world).

Additional Embodiment

FIG. 16 is a top view of the suggested members assembled for use with 5.1 and/or 7.1 surround sound platform of embodiments that can be assembled and placed on a gamer's chair, music type stand, two microphone stands, or on the back of any type chair, and showing the various slots whereas they can be fastened by screws or any other appropriate fastening means for easy adjustments. For mounting on a desk chair or computer chair or any other type of chair, a pair of brackets, such as 196, can be cut or molded to the shape of the back of the chair to replace the 190 and 192 arrangement. It is understood that these members can be in any design preferred and not necessarily as indicated herein, as long as the concept of miniaturization is withheld, and the radius of the distance from the listener's center-point is maintained. In this case the radius is 14 inches. As heretofore mentioned, the shapes of the members are not critical as long as the distances between the screw holes or slots are as shown herein. However, members 128 and 130 require a circular shape to allow for the width of the listener's body. From 136 to 138 on member 156 from the middle of the cutout slots, the measurement should be 15½ inches and the five slots should be cut out an inch in each direction. This allows for ample adjustment. From 124 to 132 on member 128 the measurement should be 12½ inches. The same applies for member 130 between 126 and 134. Member 114 and 116 should measure about 9½ inches long and the slots at 120 and 122 should be about 3 inches long. The front end of 114 and 116 can be cut diagonal or rounded or any shape to suit the type of speaker being used. Speakers can be screwed on from their bottom, attached with Velco® or attached to a 3 to 4 inch angle iron member such as 208. The various slots provide ample room for adjustments to a prescribed miniaturization, as well as a personal preference for the listener. They also represent adjustment areas to fine tune the overall circular arrangement of the speaker placement. Those rectangular slots may also be substituted with drilled holes as indicated in FIG. 13. The width of said member 198 is about 3½ inches but not critical and the height should be in keeping with the standard recommendations for the height of the two surround speakers, to be just about 3 inches above the level of the listener's ears.

Figure 19:
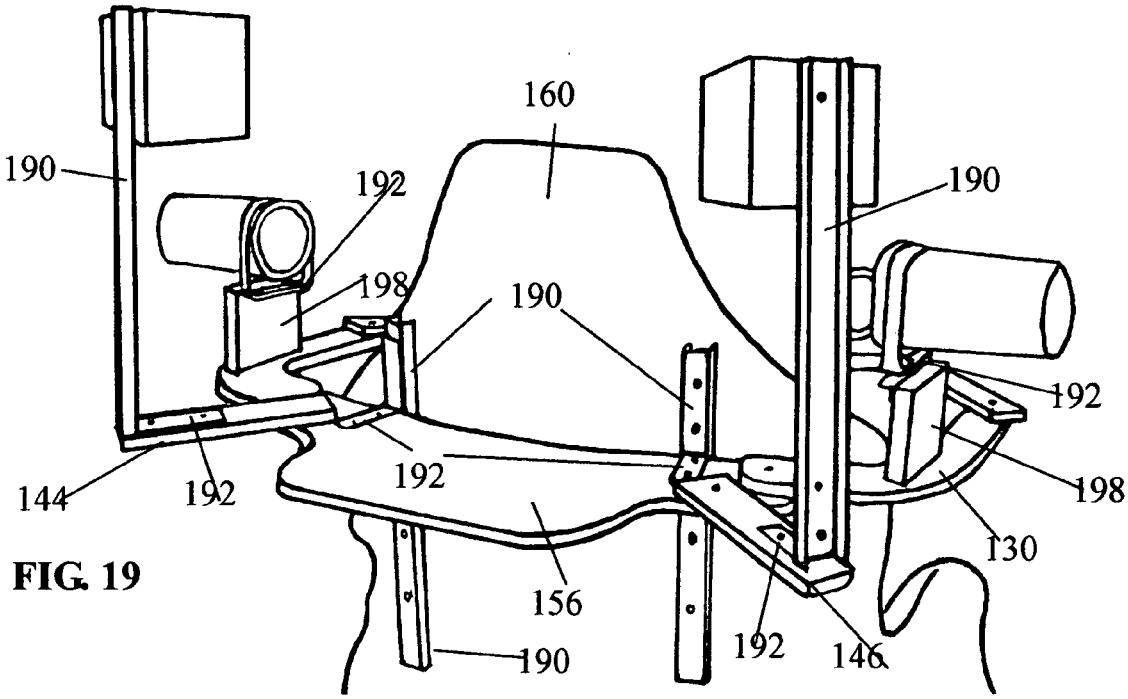
FIG. 19 illustrates a perspective view showing the layout behind the gamers' chair of the 5.1/7.1 same surround sound platform minus the center speaker.

FIG. 17 illustrates a top view of a layout for 7.1 surround sound for a gamer's chair, showing how the members in FIG. 16 connect to one another, with designated points for the speakers positions on the imaginary 28 inch circle. Member 116 connects at its 120 to member 128 at its drilled hole 124. Member 128 connects at its 132 to member 156 at it's drilled hole or slot 136. Member 118 connects at its 122 to member 130 at its drilled hole 126. Member 130 connects at its 134 to member 156 at its drilled hole or slot 138. The diagonal shape on the end of 116 and 118 can vary from short to long to accommodate the imaginary circle, where 190 is mounted to mount the two left and right front speakers. FIG. 18 illustrates a perspective view of a miniaturized 5.1 and 7.1 surround sound platform embodiment mounted on a gamer's chair, minus the center speaker as depicted in the overhead layout of FIG. 17. FIG. 19 illustrates a perspective view showing the layout behind the gamers' chair of the 5.1/7.1 same surround sound platform minus the center speaker. Two strips of aluminum channel, or any type of strong support medium approximately 12 inches in length, 190, are attached to the back of the chair vertically. Two small L type mounting brackets, 192 are attached to the strips where the rear shelf, 156 is fastened horizontally. Two more 12 inch strips of channel, 190, are mounted vertically onto the L type brackets where the two rear surround speakers are mounted at the prescribed 12 inches above the listener's ears and center-point, and at the desired radius and circular degrees for 7.1 listening. The space at 162 on the extended shelf, 108 provides a place for a subwoofer if desired, should the listener desire more bass than radiates from the floor placement.

Additional Embodiment

Figure 20:
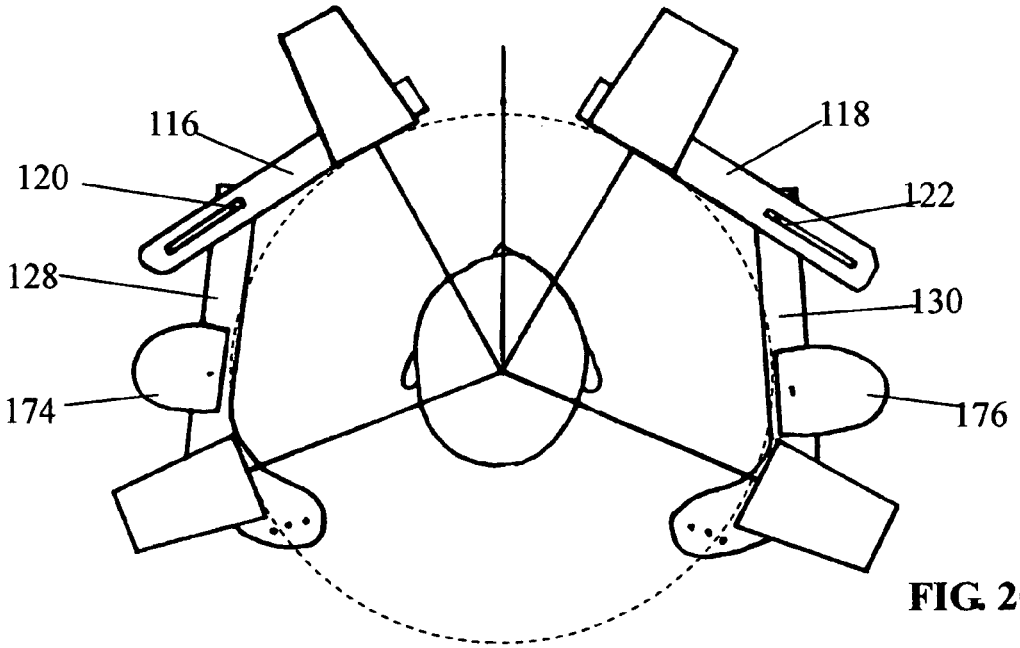
FIG. 20 shows a top view of a parts layout for an embodiment which would utilize a circle with a diameter of 20 inches and a radius of 10 inches.
Figure 23:
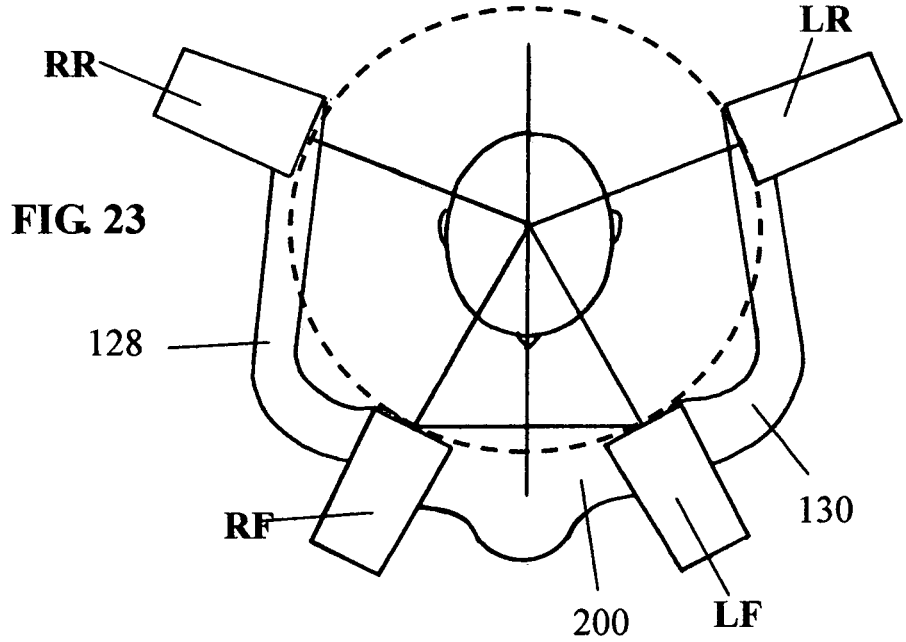
FIG. 23 illustrates a perspective view of a 5.1 platform embodiment eliminating the center speaker that is mounted to a harmonica type mount.
Figure 24:
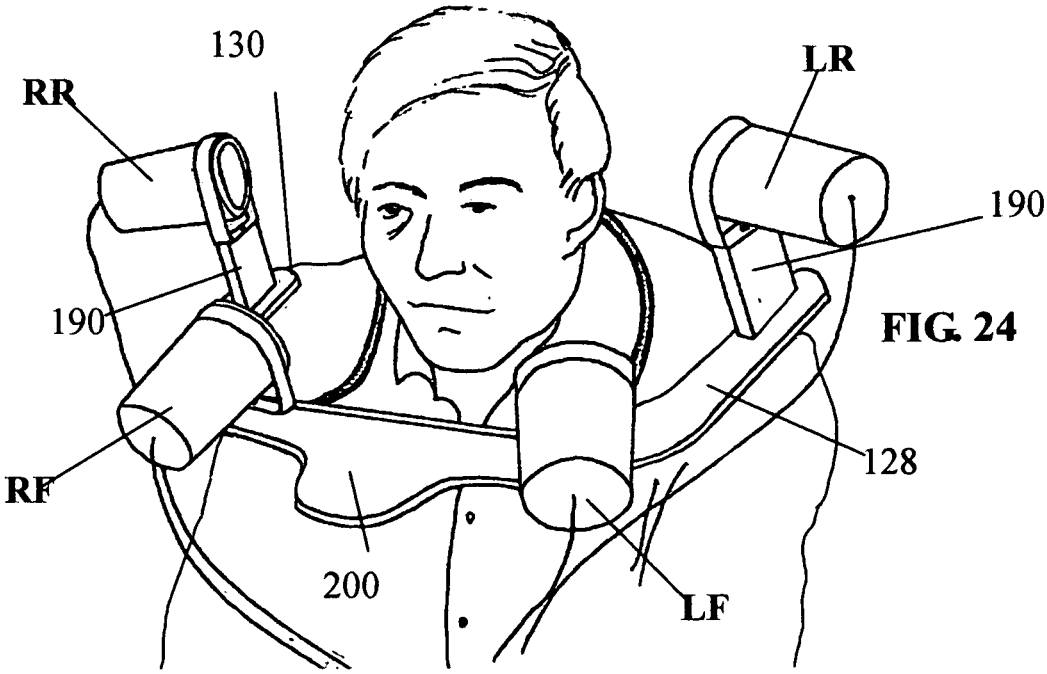
FIG. 24 shows a top view of parts layout for an embodiment which would utilize a circle with a diameter of 18 inches with a 9 inch radius.

Several positions are shown here for adjustments of the parts in FIG. 16 for four different scales in miniature. FIG. 20 shows a top view of a parts layout for an embodiment which would utilize a circle with a diameter of 20 inches and a radius of 10 inches, or 0.834 of an inch to the foot. FIG. 21 shows a top view of a parts layout for an embodiment which would utilize a circle with a diameter of 22 inches and a radius of 11 inches, or 0.917 of an inch to the foot. FIG. 22 shows a top view of a parts layout for an embodiment which would utilize a circle with a diameter of 24 inches and a radius of 12 inches, or 1 inch to the foot. FIG. 23 illustrates a perspective view of a 5.1 platform embodiment eliminating the center speaker that is attached to a harmonica type mount. Member 200 is a smaller version of 156, with drilled holes 202 and 204 11½ inches apart. This embodiment would use the layout of parts shown in the top view of FIG. 24 utilizing an 18 inch diameter of the imaginary circle and a 9 inch radius to the center point, or 0.75=¾ inch to the foot. Distance from the ears to the speakers would likely be about 6 inches.

Additional Embodiment

Figure 27:
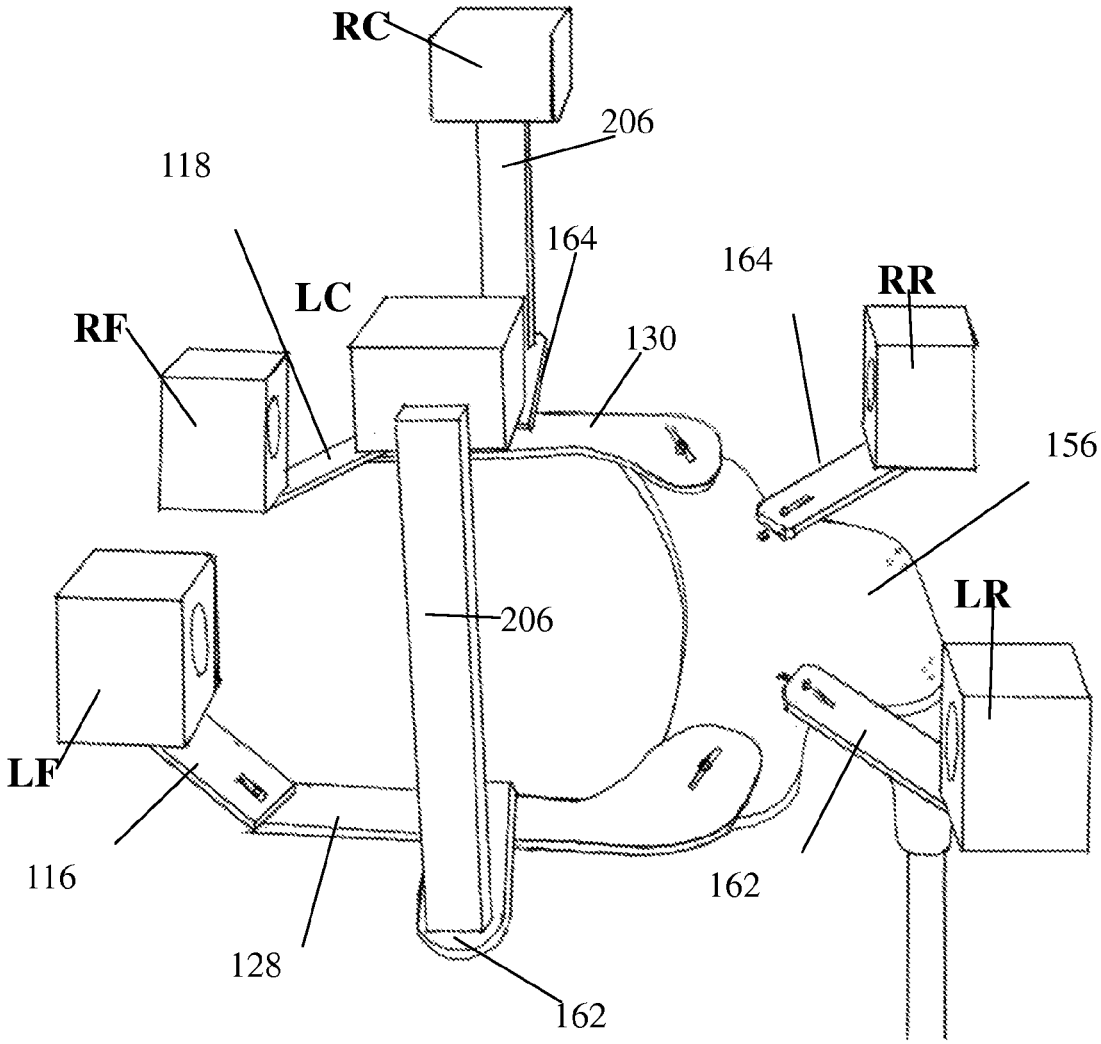
FIG. 27 illustrates a perspective view of a unique embodiment and a new concept in miniature, whereas a six speaker placement plus subwoofer provides the listener with an exciting mix of sounds from front, sides, above and the rear.

FIG. 25 is a top view of the parts assembled for an embodiment in the FIG. 27 perspective view of a new and unique miniaturized platform for speakers to radiate sounds from in front, above and behind the listener, based on an imaginary circle of 28 inches in diameter, or 1.167 inches to the foot. The miniaturized platform is not limited only to this scale, and can even be adapted to feet or meters, which has not been seen in any prior art. The assembly of the parts is the same as for the embodiment in FIG. 17 with the addition of 162 and 164. The middle speakers, LC and RC, are mounted on speaker poles 206, which are long enough to hang them at a height of 14 inches. FIG. 26 illustrates the speaker placement for the embodiment in FIG. 27 to deliver surround sounds in front, above and behind the listener. FIG. 27 illustrates a perspective view of the unique embodiment and a new concept in miniature, whereas a six speaker placement plus subwoofer provides the listener with a unique mix of sounds from front, sides, above and the rear. Discarding conventional standards, this is a new concept of a six speaker placement to provide 180 degree horizontal listening and 90 degree vertical listening. Speaker designations are: LF—Left front, RF—Right front, LC—Left Center, RC—Right center, LF—Left rear, RR—Right rear. In any and all of these applications, the miniaturization or adherence to the scale measurements of the foot to the inch will apply. Tests have proven that overhead sounds such as thunder, jets flying over, explosions etc., can be heard and located and identified from above. The mixing process for the unusual setup utilizes the usual panning between all speakers on a multi-bus preferably automated mixing console, and with computer programs which provide for 5.1 surrounds mixing.

Figure 28A:
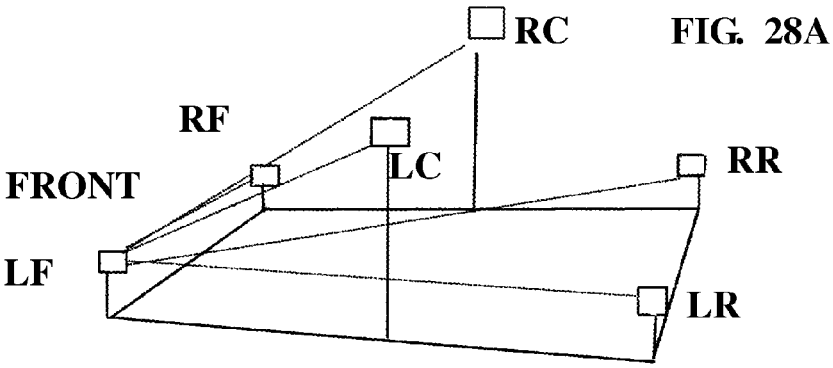
FIG. 28A shows panning mix of sounds between LF-RF, LF-LC, LF-RC, LF-LR, and LF-RR.
Figure 28B:
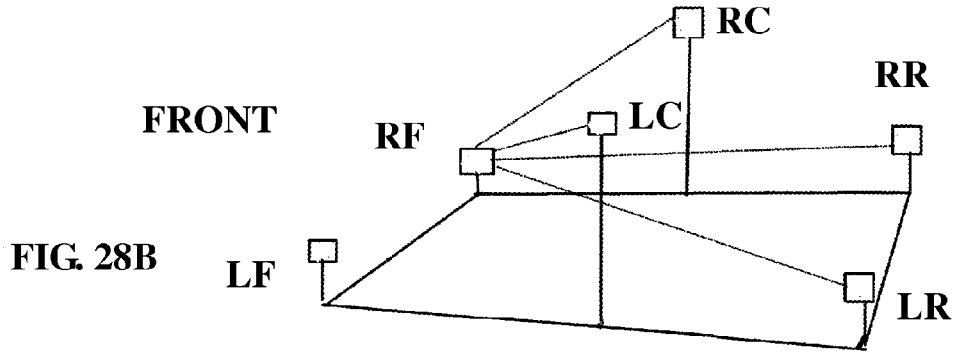
FIG. 28B shows panning mix of sounds between RF-LC, RF-RC, RF-LR and RF-RR
Figure 28C:
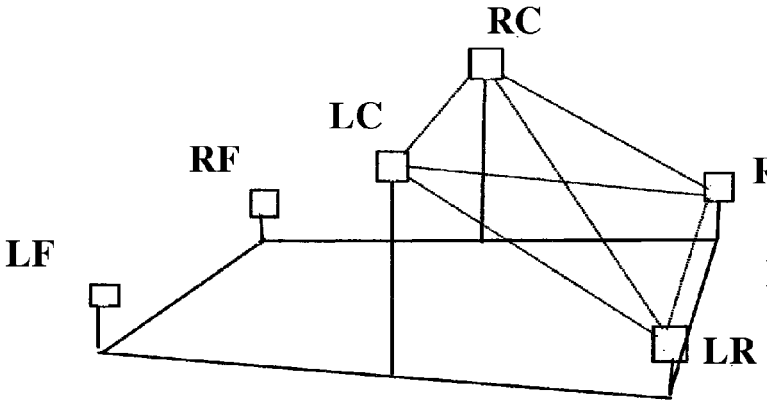
FIG. 28C shows panning a mix of sounds between LC-RC, LC-LR, LC-RR and also RC-LR, RC-RR and LR-RR.

The addition of two more channels or busses to the 5.1 mix provides for the upper vertical sounds. As shown in FIGS. 28A, 28B and 28C, panning would take place in 15 different panning positions to place the sound almost anywhere in the listener's range of hearing. FIG. 28A illustrates conventional panning mixes of sounds between LF-RF, LF-LC, LF-RC, LF-LR, and LF-RR. FIG. 28B shows panning a mix of sounds between RF-LC, RF-RC, RF-LR and RF-RR. FIG. 28C shows panning a mix of sounds between LC-RC, LC-LR, LC-RR and also RC-LR, RC-RR and LR-RR. Thus, an explosion, directly over the head of the listener, or a plane flying over can be visualized and pinpointed in the listener's mind, as well as activity directly at the sides and behind the listener. A dead center effect is accomplished by both amplifiers and speakers receiving the exact same amount of wattage. This effect is the reason for making the center speaker optional in all embodiments of the present invention mentioned herein. By taking the same identical sound track in perfect sync and phase and with the same sound levels, and feeding it to two more amplifiers and speakers, LC and RC, located directly above the mixing engineer at the same distance at 90 degrees, the sound will effectively move up to a 45 degree angle. Further manipulation of sound levels by lowering the levels on the front speakers to zero, the sound will move further up and back to directly overhead to the LC and RC speakers only. Now, if the front speakers are at zero sound levels and the rear speakers, LR and RR, are fed the exact same signal like the front speakers were before, the sound will move up to a 45 degree angle behind the listener. This would only occur with the same identical sound track in perfect sync and phase, and with the same sound levels. Increasing the rear speaker feeds while decreasing the upper middle feeds will move the sound further down and to the rear. Inversely, increasing the upper middle speaker feeds while decreasing the rear speaker feeds will move the sound further to the upper middle. Therefore, manipulation of the various panning possibilities on an automated console can achieve endless results of sound placement with the present invention. No such proposed arrangement or speaker placement has been observed in any full size surround sound prior art and there is definitely no suggestion of any such arrangement in a miniature scale setup as proposed herein.

As shown in drawings of patterns of the embodiment, all cut out slots and/or drilled holes provide adjustments for fine tuning and moving the speakers to specs, as well as to move them for any personal preferences. The measurements therein do not preclude any other small scale or miniaturized measurements for manufacture of the invention. All adjustments can have a small screw fastening each member together with a wing nut for quick and easy fine tuning in the slots provided. However, any method of fastening that will allow the members to move to change the angle and/or distance is acceptable. The connecting members at both sides in all sets of patterns allow for wide latitude of adjustments. Loudspeaker wires can be concealed with hooks or channels below the members, and/or conductors can be imbedded into the members to connect with one another when assembled. The apparatus can also be manufactured in one piece, thus having the speakers adjustable being mounted in elongated slots, however, the patterns shown with connecting movable parts allow for a more liberal approach for adjustments. A speaker manufacturer can mount its own speakers on the apparatus, and if sold in a kit form, any type of small speaker can be fastened by the consumer with screws, or with Velcro® or glue, or any method now or hereinafter known that would fasten them in the correct position. The Personal Miniaturized Loudspeaker Placement Platform can be extended to include any and all known or future real life size configurations of speakers, including height, such as duplicating the hanging of speakers at ceiling level in the front sides and rear of the room. The Personal Miniaturized Loudspeaker Placement Platform can perform standardization in an exact manner with a perfect placement in inches as compared to feet, by recreating exactly what the mixing engineer heard in the mix. And if the mix room specifications are not by the standards and published as to exactly what the speaker placement was at the time of the mix, then the home listener can re-create exactly what was intended by the mixing engineer in a miniature setting. The present invention utilizes all the aforementioned principles, inasmuch as the miniature placement of the speakers to the front, to the side and to the rear of the listener at any and all elevations produce sound that can be processed by the ear in the same manner as in full size scale, with intensity in decibels being the same as in full scale. The several adjustments will also allow a personal preference for the listener. The invention can also be made utilizing the miniaturization herein, mounting the speakers on a one piece apparatus instead of the movable parts, provided the miniature measurements are adhered to, even in an approximate size.

What is claimed is:

1. An improved placement of a plurality of loudspeakers on an apparatus for listening to multi-channel surround sound on a miniaturized circular shaped platform comprising:

(a) adjustable connecting members, adhering to internationally recognized miniature scales, and to the Inverse Square Law's treatment of sounds in open air as being the same at any distance whether close or far and, (b) said platform is constructed from any one of wood, metal, molded formations, rods, poles, or plastic substances providing for said platform in any and all scale distances in any universally recognized miniature scales of between 1:48, and 1:3.27, whereas one foot equals $\frac{1}{4}^{th}$ inch and one foot equals 3.67 inches respectively, and that said placement on said circular shaped platform is at the diameter of between 12 inches and 39.27 inches from the central position between the ears of the listener's head at the specified angles in accordance with one of the ITU-RBS 775-1 multi-channel standards published by the International Telecommunications Union for 5.1, 7.1, 9.1, 10.1, 22.1, loudspeaker placement, and emulating in miniature, the live or prerecorded sounds of a full size room, studio, theater, or open air setting, and (c) said platform comprises a radius of loudspeaker placement being 12 inches, and/or diameter of 24 inches, with the improvement utilizing a miniature scale of 1:12, or one inch equals one foot, the miniaturized multi-channel surround sound loudspeaker placement is 12 inches from the central position between the ears of the listener's head, and is not 12 feet as in a full size room setting utilizing said International Standards, and (d) wherein the platform structure of said platform comprising one flat circular member, or up to five flat members and two swivel connectors, said five flat members and said two swivel connectors form the most part of a circle of at least 250 degrees for positioning of said loudspeakers, and each being connected with a machine screw, washers and nut, with a left rear member connecting to a left forward member, and said left forward member being connected to a left swivel that connects to the left side of a front cross member, said front cross member is connected to a right swivel, said right swivel is connected to a right front member, said right front member is connected to a right rear member, and (e) all, four vertical members which hold the loudspeakers are mounted with a screw from the bottom, with a left rear vertical member mounted at 110 degrees from the front center, a left vertical front member mounted at 30 degrees left of center, a right front vertical member mounted at 30 degrees right of center and a right rear vertical member mounted at 110 degrees right of center, and since most small loudspeakers of three to five inches in size contain a screw hole, said small loudspeakers are mounted to the vertical members with a machine screw, with the rear loudspeakers slightly higher, and the front center loudspeaker is attached to the said front cross member with a machine screw, slightly lower, and (f) said two swivels provide a fine tuning circular adjustment of said platform, and a female screw type standard microphone stand screw mount is attached to the bottom of said front cross member with screws, and a microphone stand adds support in front with the rear members attached to a computer stand with machine screws, washers, and nuts; and in lieu of the computer stand supporting the platform, two more microphone stand screw mounts are mounted on the two rear members for microphone stands.

* * * * *